US005450168A

United States Patent [19]

Utsumi et al.

[11] Patent Number: 5,450,168

[45] Date of Patent: Sep. 12, 1995

[54] MOVING IMAGE PICKUP DEVICE, MEDIUM FOR PICKING UP MOVING IMAGES AND PROCESS FOR PICKING UP IMAGES CONTINUOUSLY

[75] Inventors: Minoru Utsumi; Hiroyuki Obata; Atsushi Takano; Takashi Aono, all of Tokyo, Japan

[73] Assignee: Dai Nippon Printing Co., Ltd., Tokyo, Japan

[21] Appl. No.: 828,963

[22] PCT Filed: Jun. 6, 1991

[86] PCT No.: PCT/JP91/00764

§ 371 Date: Mar. 9, 1992

§ 102(e) Date: Mar. 9, 1992

[87] PCT Pub. No.: WO91/19228

PCT Pub. Date: Dec. 12, 1991

[30] Foreign Application Priority Data

Jun. 6, 1990 [JP] Japan ..... 2-148355
Jul. 12, 1990 [JP] Japan ..... 2-186019

[51] Int. Cl.[6] ..... G03G 5/00

[52] U.S. Cl. ..... 355/211; 355/245

[58] Field of Search ..... 355/245, 246, 208, 212, 355/213, 210, 211; 346/153.1, 76 PH

[56] References Cited

U.S. PATENT DOCUMENTS

| | | | |
|---|---|---|---|
| 3,502,408 | 3/1970 | Brodie | 355/212 |
| 3,692,404 | 9/1972 | Lester et al. | 355/212 |
| 4,273,438 | 6/1981 | Nishikawa | 355/272 |
| 4,494,858 | 1/1985 | Gage et al. | 355/212 |
| 4,803,514 | 2/1989 | Hiratsuka et al. | 118/645 X |
| 5,057,875 | 10/1991 | Itoh | 355/326 |
| 5,119,133 | 6/1992 | Swain | 355/212 |
| 5,291,246 | 3/1994 | Tsukamoto | 355/210 |

*Primary Examiner*—Leo P. Picard
*Assistant Examiner*—Christopher Horgan
*Attorney, Agent, or Firm*—Dellett and Walters

[57] ABSTRACT

A charge carrier medium (41) is successively fed to a rotating (or reciprocating) photosensitive material (40) in opposite relation thereto. Making use of a beam or linear slit scanning exposure system or a planar exposure system enabling one frame to be scanned every 1/60 sec., for instance, the exposure timing is allowed to synchronize with the movement of the photosensitive material (40) and the feed of the charge carrier medium (14) to record images successively on the medium by either voltage-applied exposure or short-circuit exposure in which the charge carrier medium is pre-charged, whereby the images can be picked up as moving images. At the same time, the photosensitive material (40) is irradiated with light from the charge-clearing light source (45) to clear it of a residual charged image. Alternatively, such leakage of charges may be achieved by bringing an electrically conductive member into contact with the photosensitive material, charging it uniformly as by d.c. or a.c. discharge, heating it or bringing it into contact with an electrically conductive liquid or vapor, whereby the residual image on the photosensitive material is rapidly decayed to eliminate the influences of the residual image on the photosensitive material, thereby making it possible to obtain electrostatic images of high quality continuously.

27 Claims, 18 Drawing Sheets

FIG.1(a)
(PRIOR ART)
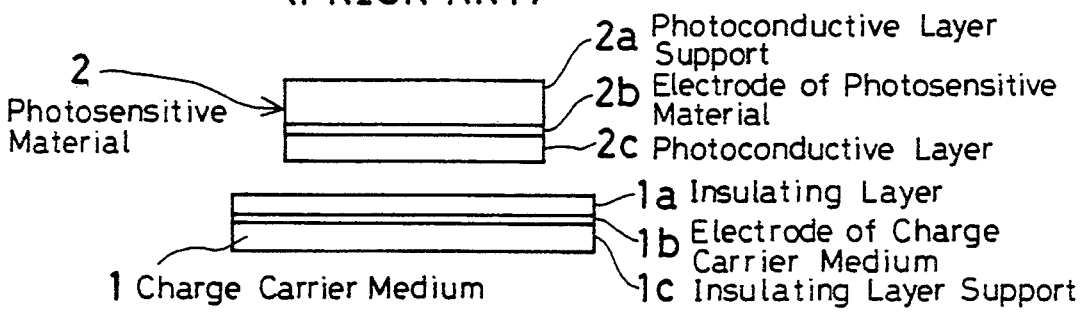
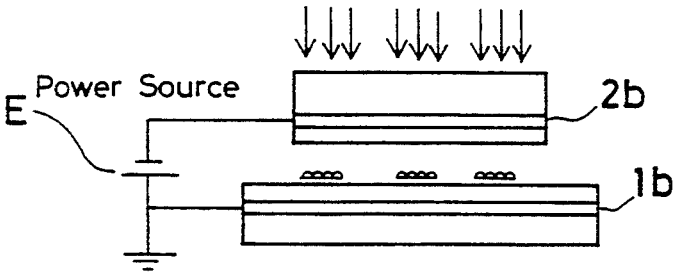
FIG.1(b)
(PRIOR ART)
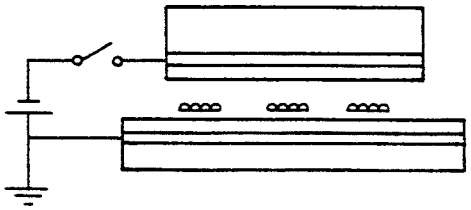
FIG.1(c)
(PRIOR ART)
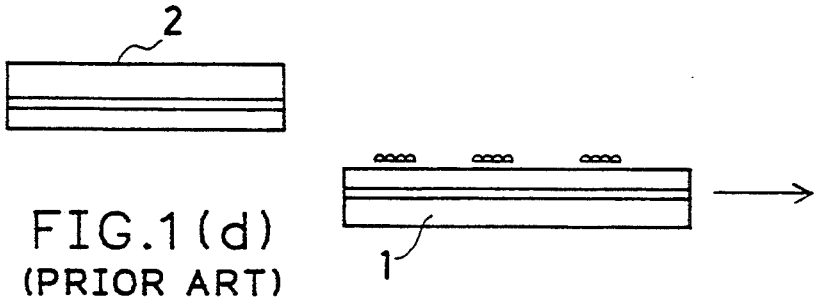
FIG.1(d)
(PRIOR ART)

10---Photosensitive Material
11, 21---Support
12---Transparent Electrode
13---Photoconductive Layer
20---Charge Carrier Medium
22---Electrode
23---Insulating Layer
30---Power Source FIG.18(a)
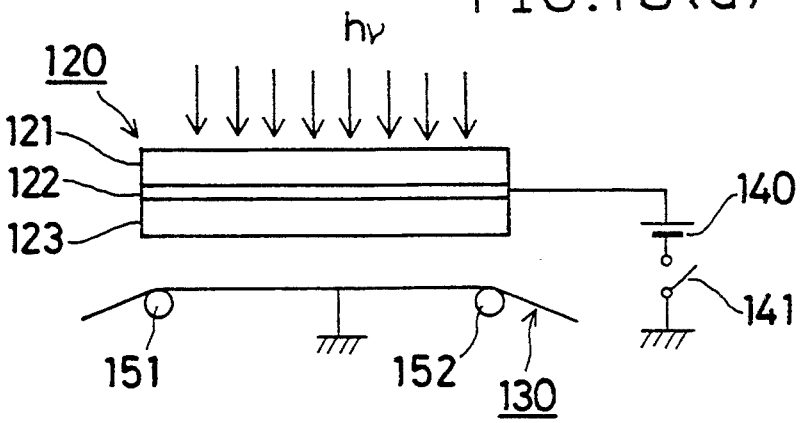
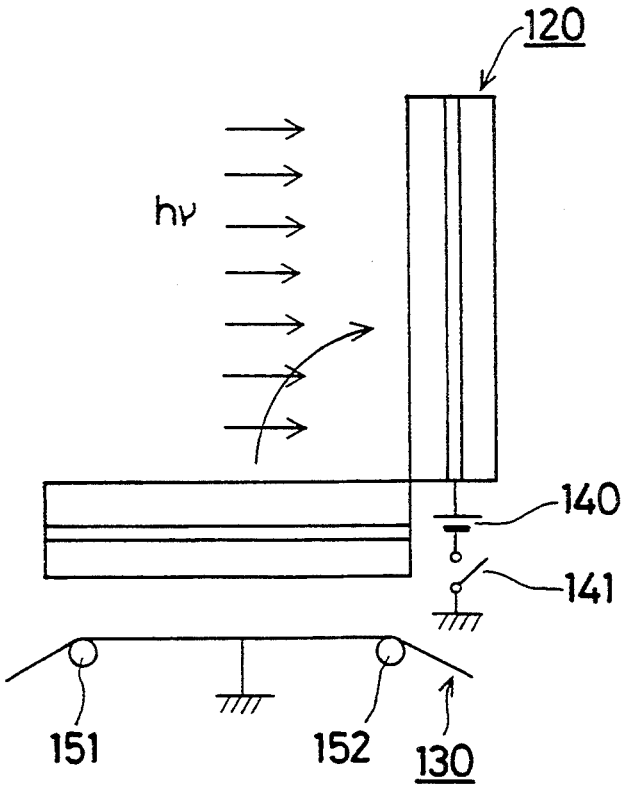
FIG.18(b)
11---Support
12---Transparent Electrode
13---Photoconductive Layer
30---Power Source
31---Switch 50--- Foil
53--- Antistatic Brush
55---Charging Roller 57---Discharge Electrode
63---Charging Unit

MOVING IMAGE PICKUP DEVICE, MEDIUM FOR PICKING UP MOVING IMAGES AND PROCESS FOR PICKING UP IMAGES CONTINUOUSLY

TECHNICAL FIELD

This invention relates to a moving image pickup device which can pick up images of good quality by making use of a recording medium capable of forming an electrostatic latent image, while influences of residual charges on the surface of a photosensitive material are eliminated by exposure, a medium for picking up moving images and a process for picking up images continuously.

BACKGROUND TECHNIQUE

As well known in the art, there is available an exposure system with the application of voltage (hereinafter called simply voltage-applied exposure) in which, while a photosensitive material having a photoconductive layer on an electrically conductive layer is located in opposition to a charge carrier medium having an insulating layer on an electrically conductive layer, an image is exposed to light with voltage applied between both said electrically conductive layers, thereby forming an electrostatic latent image on the charge carrier medium.

Such voltage-applied exposure is schematically illustrated in FIGS. 1(*a*)–1(*d*) wherein reference numeral 1 stands for a charge carrier medium, 1*a* an insulating layer, 1*b* a charge carrier medium electrode, 1*c* an insulating layer support, 2 a photosensitive material, 2*a* a photoconductor support, 2*b* an electrode of photosensitive material, 2*c* a photoconductive layer and E a power source.

The photoconductor support 2*a* formed of 1-mm thick glass is provided thereon with the transparent photosensitive electrode 2*b* formed of 1000-Å thick ITO, which is then provided thereon with the photoconductive layer 2*c* of about 10 μm in thickness to form the photosensitive material 2. With respect to this material 2, there is located the charge carrier medium 1 through an air gap of about 10 μm. The charge carrier medium 1 is formed by the vapor deposition of a 1000-Å thick aluminium electrode 1*b* on the insulating layer support 1*c* formed of 1-mm thick glass and the formation of a 10-μm thick insulating layer 10 on this electrode 1*b*.

As illustrated in FIG. 1*a*, the charge carrier medium 1 is first located with respect to the photosensitive material 2 through an air gap of the order of 10 μm, and voltage is applied between the electrodes 2*b* and 1*b* through the power source E. In a dark place, no change will occur between the electrodes, or uniform discharge will take place between the photoconductive layer 2*c* and the insulating layer 1*a* due to a minute dark current flowing through the former during the application of voltage, whereby charges corresponding to the dark current are built up on the insulating layer 1*a*. This is because the photoconductive layer 2*c* is of high resistance. Upon incidence of light from the side of the photosensitive material 2, charge carriers (electrons and positive holes) are produced through the region of the photoconductive layer 2*c* upon which the light strikes, so that major carriers can migrate onto the surface of the photoconductive layer 2*c*. As a result, discharge takes place between the photoconductive layer 2*c* and the insulating layer 1*a*, thus allowing charges to be accumulated on the insulating layer 1*a* in a quantity corresponding to the exposure dose.

After the completion of exposure, the voltage is turned off, as shown in FIG. 1*c*, and the charge carrier medium 1 is removed, as depicted in FIG. 1*d*, to finish the formation of an electrostatic latent image.

When this recording procedure is applied to planar analog recording, high resolution is obtained as is the case with silver salt photography. In addition, although the surface charges formed on the insulating layer 1*a* are exposed to an air atmosphere, they can be kept without discharge over an extended period of time regardless of whether they are stored in a dark or bright place, because air is a good insulator.

The applicant has already proposed a process for forming an electrostatic latent image using a pre-electrified charge carrier medium or photosensitive material, in which an image is exposed to light while both the electrically conductive layers remain short-circuited.

FIG. 2 illustrates such an image-forming process and FIG. 3 shows the relation between the exposure dose and the potential. In the drawings, reference numeral 3 stands for a charging unit, E a power source and 5 a switch.

A charge carrier medium 1 is first subjected to corona discharge as by applying voltage to a corona wire of the charging unit 3, whereby an insulating layer 1*a* is charged to a given potential. It is understood that this charging may be achieved either by the application of voltage through a plate electrode or by other means such as frictional or release charging. In this case, the insulating layer may be electrified with charges that are opposite in polarity to the major carriers of the photosensitive material (which are readily transportable). Often, the major carriers are positively charged in the case of an organic photosensitive material whereas, in the case of an inorganic photosensitive material, they are positively or negatively charged depending upon what the material it is formed of. Therefore, the charge carrier medium should be electrified thereon with negative charges, for instance, when the organic photosensitive material is used. Then, the thus electrified charge carrier medium 1 is located with respect to the photosensitive material 2 through an air gap of the order of 10 μm, followed by turning the switch 5 off to short-circuit the electrodes 1*b* and 2*b*. Although positive charges opposite in polarity to the negative charges on the surface of an insulating layer are induced on the electrode 1*b*, some charges are distributed to the electrode 2*b*, so that there can be a given potential difference between the charge carrier medium and the photosensitive material. For instance, when an image is exposed to light from the side of the photosensitive material in this state, carriers are produced in the photoconductive layer 2*c*, so that the positive charges can be attracted toward and transported onto the surface of the charge carrier medium. Then, they are coupled to the negative charges ionized in the air gap for neutralization, so that the positive charges ionized in the air gap can be attracted toward the charge carrier medium and neutralized with the negative charges on the surface of the insulating layer. The quantity of the positive charges neutralized with the negative charges on the surface of the insulating layer corresponds to the exposure dose; that is, the potential shown in FIG. 3 is the surface potential of the insulating layer corresponding to the exposure dose.

Thus, an electrostatic latent image being formed is tantamount to the surface potential of the insulating layer corresponding to an image. In this case, there is a drop of potential where increased exposure takes place. For instance, the resulting image becomes whitish upon toner development. Thus, the image obtained by this image-forming process is a positive image.

It is understood that when an electrostatic latent image is formed by image exposure according to the process shown in FIG. 2, using thermoplastic resin for the insulating layer 1*a*, charges opposite in polarity to the surface charges of the resin layer are induced on the electrode 1*b*. When the charge carrier medium is heated with a heater 7 in this state, as shown in FIG. 4*a*, the resin layer 1*a* is so plasticized that the surface of the resin layer is undulated, as shown at 8, by the Coulomb's force between the surface charges of the resin layer and the charges induced on the electrode. Cooling of this causes the undulation to be fixed, as shown in FIG. 4*b*, giving a positive frosted image.

It is understood that the frosted image may also be formed by forming an electrostatic latent image by usual exposure with the application of voltage and heat-treating it. In this case, however, the frosted image is a negative image.

Because of being characterized by keeping an electrostatic latent image over an extended period of time and rendering analog recording of very high resolution possible, the charge carrier medium is now considered to have various applications. So far, it has been used to record still images, but its application to recording moving images has not come in mind.

Another image exposure process is practiced as well by locating a photosensitive material 10 including a transparent electrode 12 and a photoconductive layer 13 on a support 11 in opposition to a charge carrier medium 20 including an electrode 22 and an insulating layer 23 on a support 21 and applying voltage of a given polarity between the electrodes 12 and 22 through a power source 30. A portion of the photoconductive layer exposed to light is made electrically conductive, and through that portion discharge takes place between the photosensitive material 10 and the charge carrier medium 20, so that charges, e.g., (+) charges can be accumulated on the insulating layer 23 depending upon the exposure dose. At this time, carriers are produced from the portion of the photoconductive layer 13 exposed to light, so that (−) and (+) charges can migrate to the transparent electrode 12 and the surface of the photoconductive layer, respectively. Corresponding to these charges, (−) charges ionized in an air gap are thus accumulated on the surface of the photoconductive layer.

In this way, a still image is formed on the charge carrier medium by voltage-applied exposure but, at the same time, charges of a polarity corresponding to the conditions for forming an image are accumulated on the surface of the photosensitive material as well. For instance, when selenium is used as the photosensitive material, there is such a dark decay characteristic as shown by a characteristic curve A in FIG. 6. When an organic photosensitive material is used, on the other hand, a time in a matter of several tens seconds is needed for decay, as can be seen from FIG. 7*a*. Hence, when it is intended to pick up images continuously with such a still image-recording process as shown in FIG. 5, this photosensitive material is affected by residual charges, posing a problem that electrostatic images of high quality cannot be recorded.

This invention has been accomplished to provide a solution to the above problems.

An object of this invention is to provide a moving image pickup device which can pick up moving images using a charge carrier medium.

Another object of this invention is to provide a recording medium suitable for picking up moving images.

A further object of this invention is to provide a process for picking up images continuously without causing a residual image to have some adverse influence.

SUMMARY OF THE INVENTION

According to one aspect of this invention, there is provided a moving image pickup device characterized by including a rotationally driven drum form of photosensitive material which has a photoconductive layer with or without a spacer laminated on a drum having an electrically conductive layer on its surface, a charge carrier medium which includes a transparent, electrically conductive layer and a transparent insulating layer, possibly with a spacer, laminated on a transparent support and successively fed to said drum form of photosensitive material such that said transparent insulating layer thereof is wound around said drum form of photosensitive material, means for applying voltage between said electrically conductive layers of said drum form of photosensitive material and said charge carrier medium, image exposure means for exposing said image to beam or linear slit scanning light from said charge carrier medium at a position where said drum form of photosensitive material is opposite to said charge carrier medium and a charge-clearing light source for irradiating said drum form of photosensitive material with light to clear it of a residual charged image, said scanning for exposing said image to light synchronizing with the rotation of said drum-form of photosensitive material and the feed of said charge carrier medium to record said image on said charge carrier medium successively frame by frame at a given timing.

This aspect is further characterized in that the insulating layer is a thermoplastic resin layer and an additional heating means is provided to form a frosted image by voltage-applied exposure.

Another aspect of the invention is characterized by including means for charging the transparent insulating layer of the charge carrier medium uniformly, means for short-circuiting the electrically conductive layers of the drum form of photosensitive material and the charge carrier medium and image exposure means for subjecting the image to beam or linear slit scanning exposure at a position where the drum form of photosensitive material and the charge carrier medium are opposite to each other while remaining short-circuited.

This aspect of the invention is further characterized in that a thermoplastic resin layer is used as the insulating layer and an additional heating means is provided to form a frosted image by short-circuit exposure after charging.

According to the third aspect of the invention, there is provided a moving image pickup device characterized by including a plate form of photosensitive material including an electrically conductive layer and a photoconductive layer laminated on a support in this sequence, a charge carrier medium which includes an electrically conductive layer and an insulating layer laminated on a support in this sequence and is successively fed to said plate form of photosensitive material in opposite relation thereto, means for driving said plate form of photosensitive material to reciprocate it in the direction perpendicular to the direction of movement of said charge carrier medium, means for applying voltage between said electrically conductive layers of said photosensitive material and said charge carrier medium, image exposure means for subjecting said image to planar exposure through said photosensitive material and a charge-clearing light source adapted to reciprocate for irradiating said photosensitive material with light at any position that is not opposite to said charge carrier medium, thereby clearing it of a residual charged image, the timing of said planar exposure synchronizing with the reciprocation of said photosensitive material and the feed of said charge carrier medium to record said image on said charge carrier medium successively frame by frame at a given timing.

The fourth aspect of the invention is characterized by including means for charging the insulating layer of the charge carrier medium uniformly, means for short-circuiting the electrically conductive layers of the photosensitive material and the charge carrier medium and exposure means for subjecting the image to planar exposure through the photosensitive material while said electrically conductive layers remain short-circuited to record an electrostatic latent image by short-circuit exposure after charging.

According to the fifth aspect of the invention, there is provided a moving image pickup device characterized by including a rotationally driven, electrically conductive drum having an insulating spacer laminated on a drum having an electrically conductive layer formed on its surface, a recording medium which includes a transparent, electrically conductive layer and a photoconductive fine particle-containing transparent insulating resin layer laminated on a transparent support in this sequence and successively fed to said drum such that said transparent insulating resin layer thereof is wound around said drum in opposite relation to said spacer layer, means for applying voltage between said electrically conductive layers of said drum and recording medium and image exposure means for subjecting said image to beam or linear slit scanning exposure from said recording medium at a position where said electrically conductive drum is opposite to said recording medium, said image exposure scanning synchronizing with the rotation of said electrically conductive drum and the feed of said recording medium to record said image on said recording medium successively frame by frame at a given timing.

According to the sixth aspect of the invention, there is provided a moving image pickup device characterized by including a rotationally driven drum form of electrical conductor having an insulating spacer laminated on a drum having an electrically conductive layer formed on its surface, a recording medium which includes a transparent, electrically conductive layer and a photoconductive fine particle-containing transparent insulating layer laminated on a transparent support with said transparent insulating layer being successively fed to said drum form of electrical conductor, means for charging said transparent insulating layer of said recording medium uniformly, means for short-circuiting said drum form of electrical conductor and said recording medium, and image exposure means for subjecting said image to beam or linear slit scanning exposure from said recording medium at a position where said drum form of electrical conductor and said recording medium are opposite to each other while remaining short-circuited, said image exposure scanning synchronizing with the rotation of said drum form of electrical conductor and the feed of said recording medium to record said image on said recording medium successively frame by frame at a giving timing.

The seventh aspect of the invention is characterized in that the photoconductive fine particles are present in the insulating resin layer and in the vicinity of the surface thereof in the form of a single or plural layers.

According to the 8th aspect of the invention, there is provided a process for picking up and recording electrostatic images continuously in which, while a photosensitive material having a photoconductive layer formed on an electrically conductive layer is located in opposition to a charge carrier medium having an insulating layer on an electrically conductive layer, said images are exposed to light with the application of voltage between both said electrically conductive layers, characterized in that after said voltage-applied exposure, residual charges are removed out of the surface of said photosensitive material or a residual image is eliminated from the surface of said photosensitive material by uniform charging, the next voltage-applied exposure is carried out.

BRIEF DESCRIPTION OF THE DRAWINGS

FIGS. 1*a*–1*d* are views for illustrating a voltage-applied exposure system, FIG. 2 as a view showing another example of the image exposure system, FIGS. 18*a* and 18*b* are views of views one embodiment of this invention wherein a photosensitive material is cleared of a residual image by its exposure to light.

BEST MODE FOR CARRYING OUT THE INVENTION

Figure 8A:
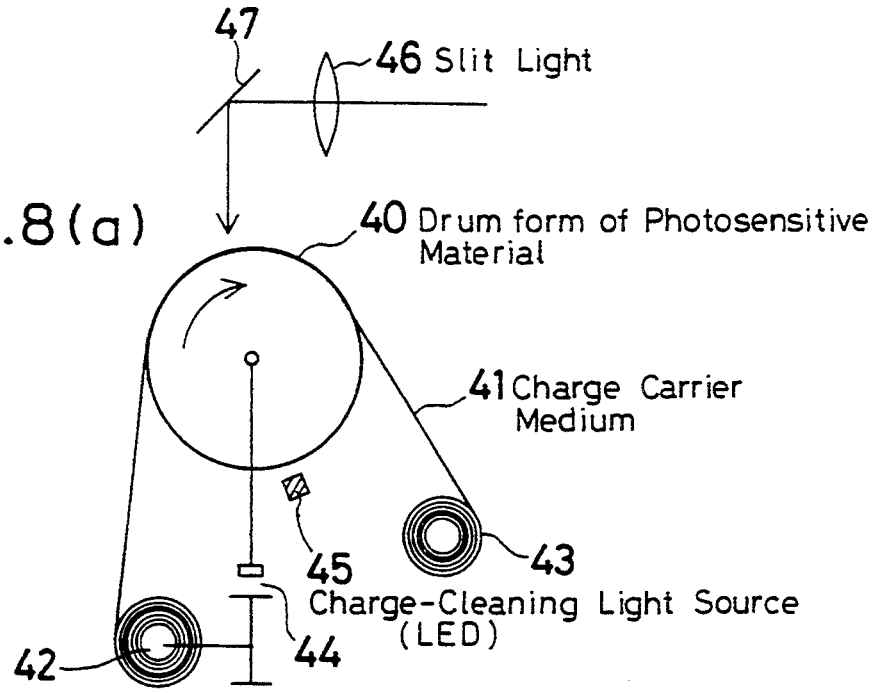
FIGS. 8*a*–8*c* are views showing one embodiment of the moving image pickup device according to this invention.
Figure 8B:
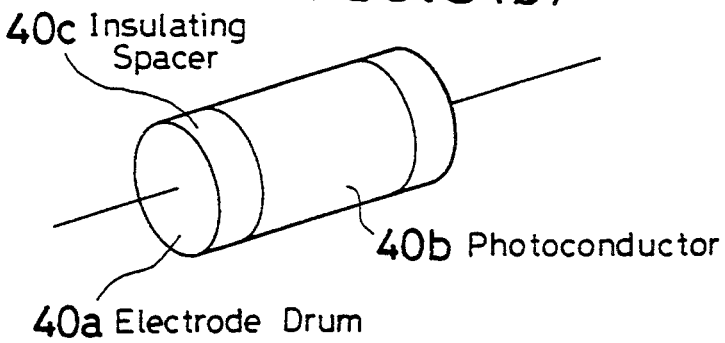

FIGS. 8(*a*)–8(*c*) represent one embodiment of the moving image pickup device schematically. In FIG. 8, reference numeral 40 stands for a drum of photosensitive material, 41 a charge carrier medium , 42 a charge carrier medium feed roller, 43 a charge carrier medium takeup roller, 44 a power source, 45 a charge-clearing light source, 46 a focusing lens and 47 a reflecting mirror.

Figure 8C:
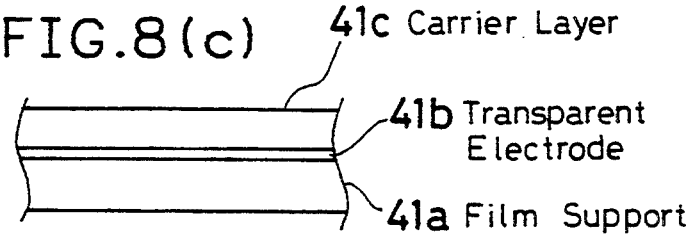

As can be best seen from FIGS. 8(*a*)–8(*c*), the drum 40 is built up of an electrode drum 40, a photoconductor 40*b* formed thereon and insulating spacers 40*c* wound around the peripheral edges thereof, and is designed to be rotationally driven at a given speed by means of a driving means, which is not shown. As can be best seen from FIG. 8*c*, the charge carrier medium 41 is a transparent assembly made up of a film support 41*a* and a transparent electrode 41*b* and an insulating layer 41*c* formed thereon, This medium is continuously or intermittently fed to the drum 40 through the feed and takeup rolls 42 and 43 synchronously with linear slit light scanning, such that it is wound around said drum. Bear in mind that a spacer may be provided on the charge carrier medium 41 as by lamination so as to space the photoconductor 40*b* away from the charge carrier medium at a constant interval. In this case, the spacers 40*c* may be removed from the photosensitive drum.

The linear slit light scanning may be achieved as by scanning a linear slit (not shown) with respect to the focusing lens 46 at a given speed, thereby cutting out an actually moving subject image linearly and focusing it on the photosensitive material. A given voltage is impressed between the electrodes of the drum 40 and charge carrier medium 41 through the power source 44. The charge-clearing light source 45 built up of linearly arranged LEDs, etc. should emit light having a wavelength lying in the region of wavelengths to which the photosensitive material is sensitive, and is provided to give that light to the photosensitive material to clear it of residual charges, if any.

For actual image pickup, for instance, the linear slit is scanned to cut out the moving subject image at such a timing as to give one frame every 1/60 sec. and for focusing it on the drum 40 of photosensitive material through the focusing lens 46, reflecting mirror 47 and charge carrier medium 41. The drum 40 is rotated at a speed synchronous with the linear slit light scanning and, at the same time, the charge carrier medium 41 is also continuously fed thereto synchronously with the linear slit light scanning. This permits carriers to be produced in the photoconductor 40*b* of the drum 40, but these carriers are attracted toward the charge carrier medium 41, because the voltage is applied between the drum 40 and the charge carrier medium 41. In consequence, discharge takes place within an air gap between the drum 40 and the charge carrier medium 41, causing charges to be accumulated on the charge carrier medium 41 to form an electrostatic latent image. The image exposure takes place at such a speed as to provide one frame every 1/60 sec. and the drum 40 and charge carrier medium 41 are continuously moved synchronously with the linear slit light scanning; that is, the moving subject image can be picked up and recorded on the charge carrier medium 41. By reading the recorded image at the same timing as recording, it can be visually observed as is the case with a telescreen.

When the moving image is successively exposed to light at a high speed in this way, charges opposite in polarity to the charges on the charge carrier medium 41 remain on the drum 40 of photosensitive material, giving rise to a ghost image. To eliminate such a ghost image, the photoconductor is irradiated with the light from the charge-clearing light source 45 to make it electrically conductive for leakage of residual charges. Note that while scanning exposure may be carried out with a beam spot in linear sequence instead of using the linear slit light scanning, it is then required to enhance the intensity of beam applied, because such high-speed scanning results in a decrease in the exposure dose per unit area.

It is understood that the photosensitive material used must be well fit for such high-speed scanning exposure as carried out by a moving image pickup device. In the case of an inorganic photoconductor such as amorphous silicon (a-Si), the resulting carriers generally have a short life time but a large mobility. In the case of an organic photoconductor (OPC), on the other hand, the resulting carriers generally have a long life time but a small mobility. Hence, an inorganic photosensitive material such as a-Si or a laminated layer type of inorganic-/organic photosensitive materials may be more effectively used as high frame speeds or beam scanning exposure, while OPC may be more effectively used at low frame speeds.

Figure 9:
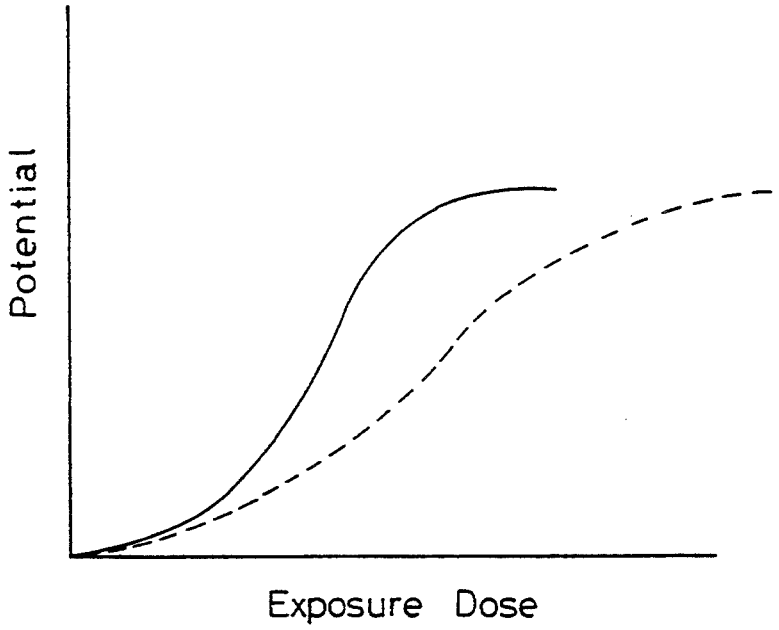
FIG. 9 is a graph showing the relation between the exposure dose and the recording potential of a charge carrier medium.

The relation between the exposure dose and the recording potential of the charge carrier medium is represented by such a characteristic as shown by a solid line in FIG. 9, which indicates that charges are saturated at a certain or higher exposure dose. However, increasing the scanning speed gives rise to a decrease in the quantity of light per unit area and so limits the quantity of charges, thus making the dynamic range wider, as can be seen from such an characteristic as apparently shown by a broken line in FIG. 9.

Note that if a transparent thermoplastic resin layer is used as the transparent insulating layer of the charge carrier medium shown in FIG. 8 and an additional heater for heating the charge carrier medium after image exposure is provided, it is then possible to form a frosted image.

Figure 10:
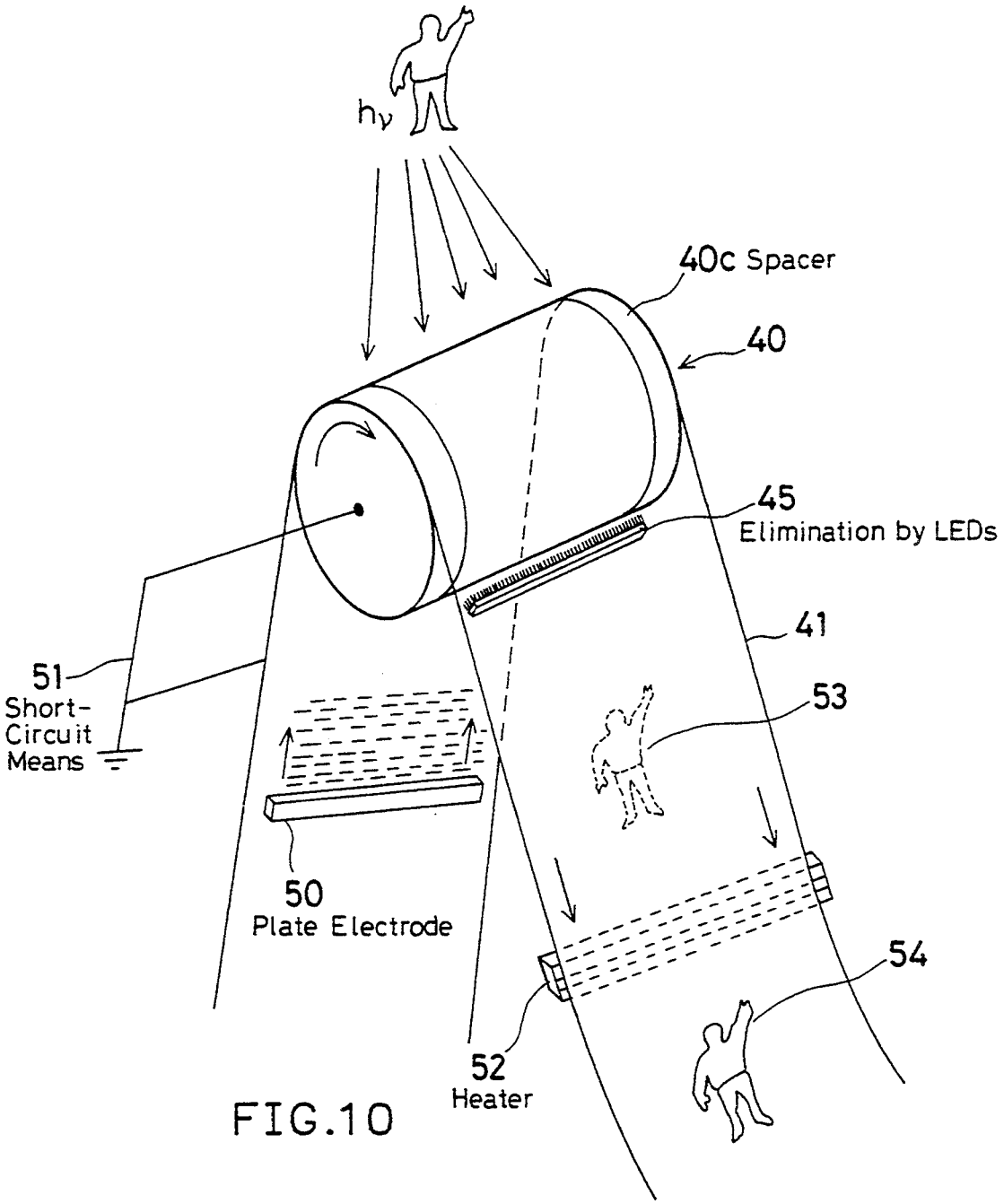
FIG. 10 is a schematic view showing another embodiment of the moving image pickup device according to this invention, wherein a frosted image is used.

FIG. 10 represents another embodiment of the moving image pickup device according to this invention. In FIG. 10, reference numeral 50 denotes a plate electrode, 52 short-circuit means, 51 a heater, 53 an electrostatic latent image and 54 a frosted image.

Figure 2:
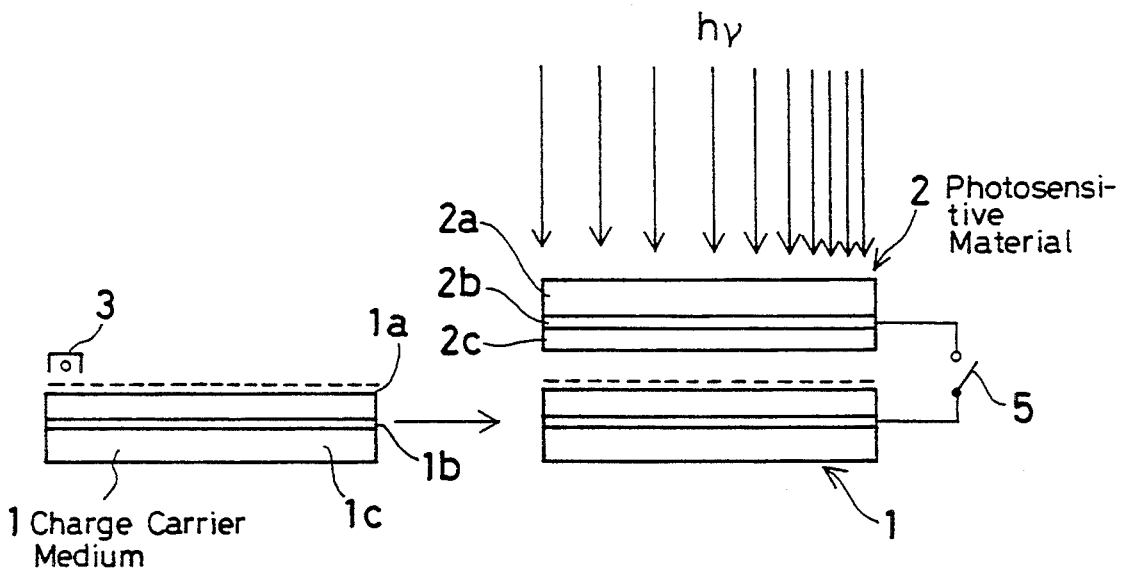
Figure 3:
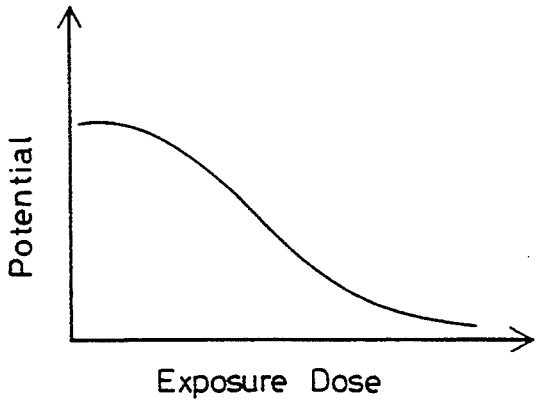
FIG. 3 is a graph showing the relation between the exposure dose and the potential in the system of FIG. 2, FIGS. 4*a* and 4*b* are is views for illustrating how to form a frosted image.
Figure 4A:
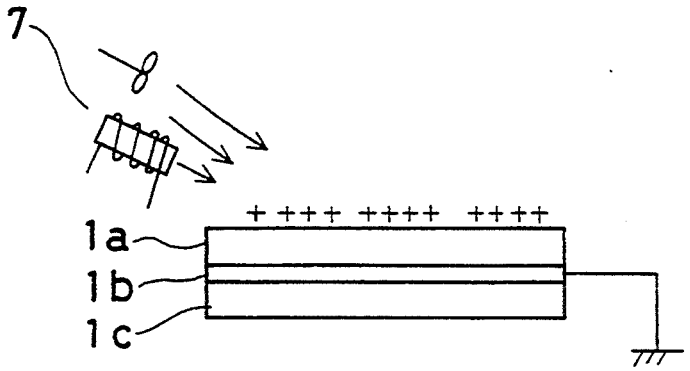
Figure 4B:
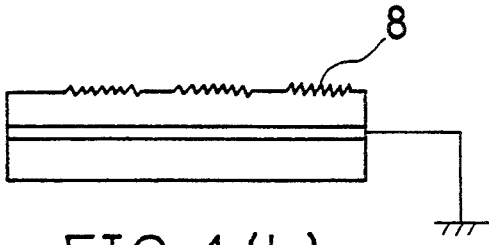

This embodiment is similar to that of FIGS. 8(*a*)–8(*c*) in that a moving subject is subjected to scanning exposure in sequence, while the drum 50 of photosensitive material is rotated synchronously with this scanning and the charge carrier medium 51 is successively fed thereto. In this embodiment, however, a thermoplastic resin is used for the charge carrier layer of the charge carrier medium 51. Then, the thermoplastic resin layer is pre-charged following the procedure explained with reference to FIG. 2. Subsequently, the charge carrier medium is fed to the photosensitive drum such that the former is wound around the latter with the thermoplastic resin layer located in opposition to the photosensitive material 50. During image exposure, the drum and charge carrier medium are short-circuited by means of the short-circuit means 51. In consequence, the electrostatic latent image 53 is formed on the charge carrier medium. In order to obtain a frosted image, this latent image 53 may be heated with the aid of the heater 52. Note that a charged image remaining on the surface of the photosensitive material 40 can be cleared away by exposure to the light from LEDs 55.

It is understood that only the formation of the electrostatic latent image may be carried out as usual in the absence of the heater 52 in FIG. 10. In this case, it goes without saying that the charge carrier medium may be made up of an insulating layer that is not thermoplastic. In addition, the spacer 40*c* may be laminated on the charge carrier medium rather than on the photosensitive material.

Figure 11A:
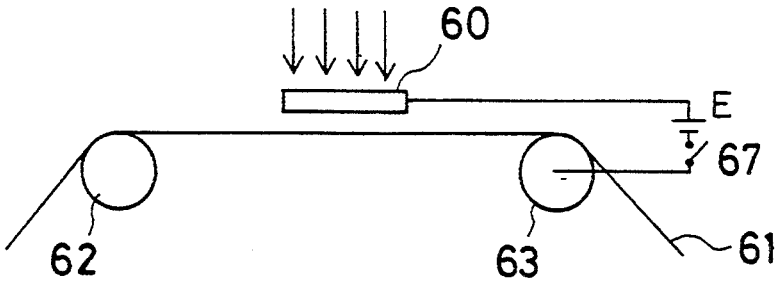
FIGS. 11*a*–11*c* and 12*a*–12*c* are views showing a further embodiment of the moving image pickup device according to this invention wherein planar exposure is used.
Figure 11B:
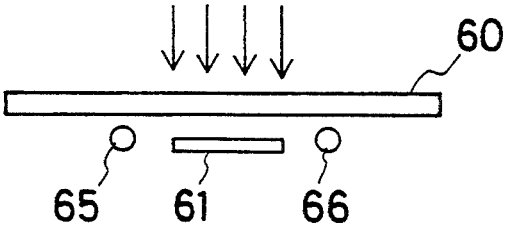
Figure 11C:
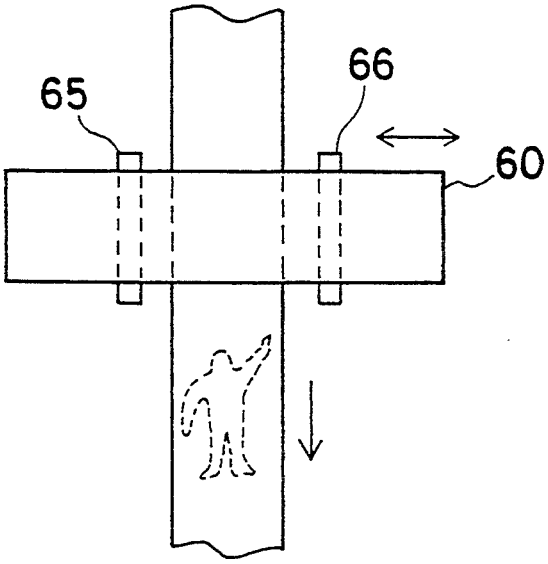

FIGS. 11(*a*)–11(*c*) represent a further embodiment of the moving image pickup device according to this invention. In FIGS. 11(*a*)–11(*c*), reference numeral 60 stands for a plate form of photosensitive material, 61 a charge carrier medium, 62 a feed roller, 63 a takeup roller, 65 and 68 charge-clearing light sources, and 67 a switch.

In this embodiment, a moving subject image is formed on the photosensitive plate 60 to record it as a moving image.

As can be seen from FIG. 11*a*, the charge carrier medium 61 is successively fed to the plate 60 through the feed and takeup rollers 62 and 63 synchronously with the exposure timing. As can be best seen from FIGS. 11*b* (a side view) and 11*c* (a plan view), the plate 60 is in a rectangular form that is longer than the width of the charge carrier medium 61 in the direction perpendicular to the direction of movement of the charge carrier medium, and is designed to be horizontally reciprocated by a driving means (not shown) such that it crosses the charge carrier medium synchronously with the exposure timing. On both sides of the charge carrier medium, there are provided charge-clearing light sources 65 and 66 each built up of linear LEDs, which emit light for the irradiation of the photosensitive plate plane.

According to such an arrangement, the switch 67, which serves as a shutter as well, is turned on and off in a cycle of 1/60 sec. Synchronously with this, the charge carrier medium 61 is intermittently fed to the photosensitive plate 60, which is reciprocating horizontally for planar exposure. In addition, at a position where the plate 60 is not opposite to the charge carrier medium 61, the plate 60 is irradiated with the light from the charge-clearing light sources 65 and 66 for leakage of charges, thereby preventing residual charges from being accumulated on the plate 60. In this way, electrostatic latent images can be recorded continuously.

Note that if a transparent thermoplastic resin layer is used as the transparent insulating layer of the charge carrier medium shown in FIGS. 11(*a*)–11(*c*) and an additional heater for heating the charge carrier medium after image exposure is provided, it is then possible to form a frosted image.

Figure 12A:
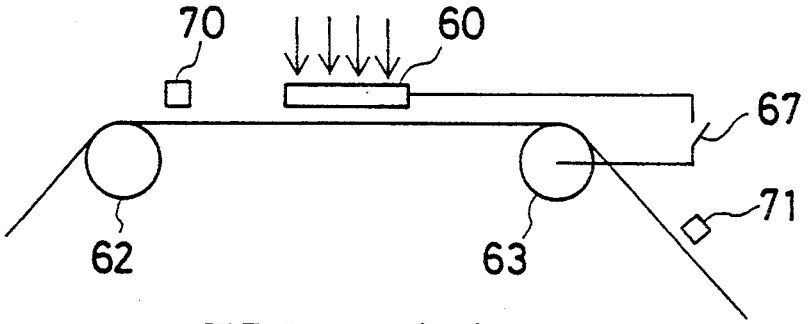
Figure 12B:
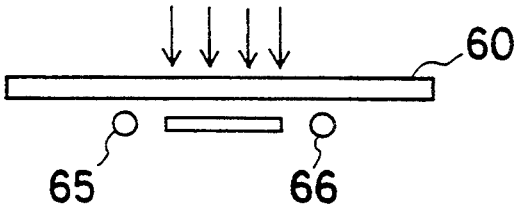
Figure 12C:
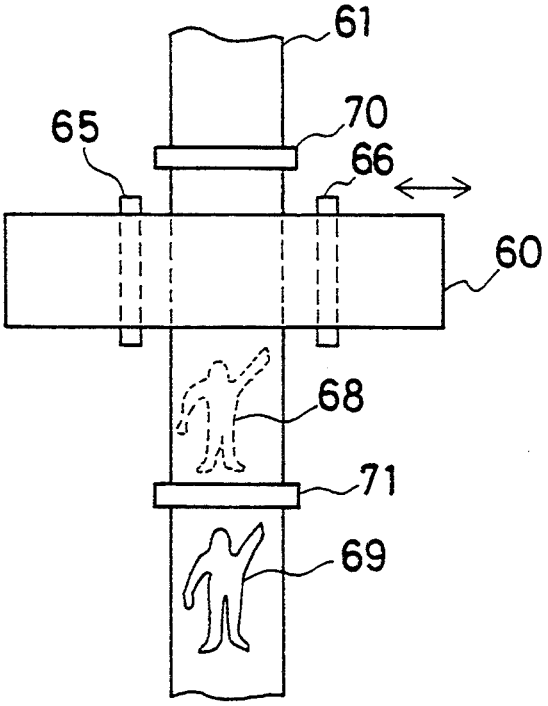

FIGS. 12(*a*–12(*c*) represent a still further embodiment of this invention wherein a positive frosted image is formed. In FIGS. 12(*a*)–12(*c*), the same reference numerals as used in FIGS. 11(*a*)–11(*c*) indicate the same parts, and 69 stands for a frosted image, 70 a charging unit and 71 a heater.

According to this embodiment, a thermoplastic resin is used for the charge carrier layer of the charge carrier medium 61, and the thermoplastic resin layer is uniformly electrified by the charging unit 70, as is the case with the embodiment of FIG. 10. Using the switch 67, the photosensitive material 60 and charge carrier medium 61 are held on and off in a cycle of, e.g., 1/60 sec. and synchronously with this on-and-off cycle, the charge carrier medium 61 is intermittently fed to the photosensitive material 60, which is reciprocating horizontally for planar exposure. In addition, at a position where the photosensitive material 60 is not opposite to the charge carrier medium 61, the photosensitive material 60 is irradiated with the light from the charge-clearing light sources 65 and 66 for leakage of charges, thereby preventing accumulation of residual charges thereon. In this way, electrostatic latent images 68 can be formed continuously. Then, the charge carrier medium is heated with the heater 71 to plasticize the resin layer, so that the surface of the resin layer can be undulated by the Coulomb's force acting between the charges on the resin layer and the charges induced on the electrode of the charge carrier medium. Subsequent cooling of the resin layer for fixation gives a frosted image.

It is understood that only the formation of the electrostatic latent image may be carried out as usual in the absence of the heater 71 in FIGS. 12(*a*)–12(*c*). In this case, it goes without saying that the charge carrier medium may be made up of an insulating layer that is not thermoplastic.

Throughout the above embodiments, the photosensitive material and charge carrier medium are used for image exposure to form an image on the charge carrier medium. However, if the photosensitive material has a memory function, then the structure of the moving image pickup device can be further simplified by recording an image in it.

Figure 13A:
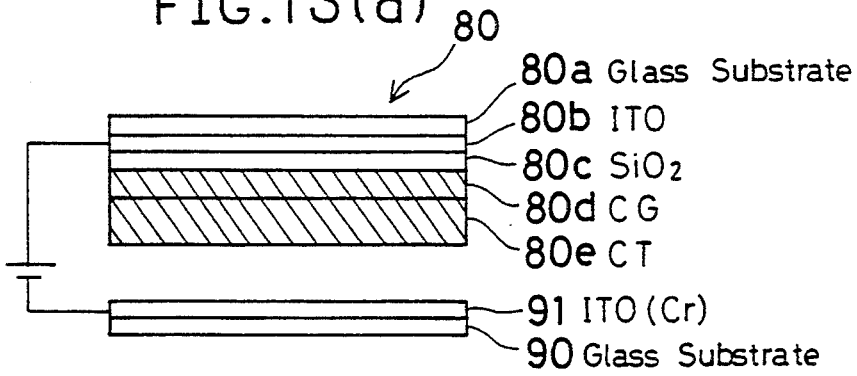
FIGS. 13*a* and 13*b* are views for illustrating a photosensitive memory.

FIGS. 13(*a*)–13(*b*) represents a photosensitive material having a memory function (hereinafter called the photosensitive memory). In FIGS. 13(*a*)–13(*b*), reference numeral 80 stands for a photosensitive memory, 80*a* a glass substrate, 80*b* a transparent electrode, 80*c* an $SiO_2$ layer, 80*d* a photoconductor, 80*e* a charge-generating layer, 80*f* a charge transport layer, 90 a glass substrate, 91 a transparent electrode and E a power source.

The photosensitive memory 80 is built up of glass substrate 80*a* and transparent electrode 80*b*, $SiO_2$ layer 80*c*, charge-generating layer 80*e* and charge transport layer 80*f* laminated thereon in this sequence. As can be seen from FIG. 13*a*, the photosensitive memory 80 is located in opposition to the electrode 91 with an air gap of about 10 μm therebetween, and a voltage of 500–800 V, for instance, is applied between the electrode 80*b* of the photosensitive memory and the electrode 91.

The reason why the memory function is obtained remains still unclarified, but it may appear to be due to the following mechanism.

Carriers are generated in a portion of the charge-generating layer on which light strikes. In the presence of an organic photosensitive material, positive charges are transported to its surface through the charge transport layer and then neutralized with electrons ionized in the air gap. The ionized ions are attracted toward the opposite electrode 91, whence they flow toward the power source. In this case, since a current path through which the generated carriers flow by way of the opposite electrode has a very low resistance, a very increased current flows through the photosensitive material. At this time, negative charges are trapped by the SiO2 layer serving as a blocking layer, so that they can function as a memory.

Figure 13B:
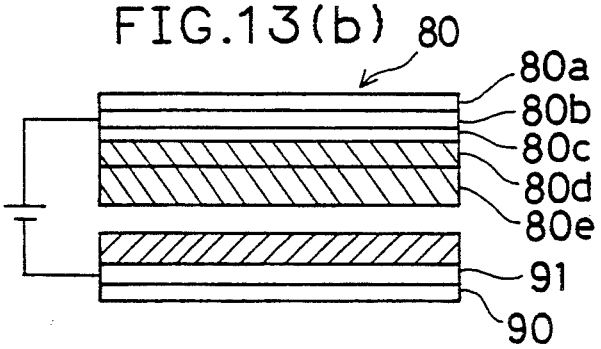

Then, while the charge carrier medium is located in opposition to the photosensitive memory, as illustrated in FIG. 13*b*, voltage is applied between the electrodes thereof. As mentioned above, the negative charges corresponding to image exposure are trapped in the photosensitive memory. In consequence, charges are injected from the electrode 80*b* thereinto, but they are carried through the charge-generating and transport layers, without being coupled to the trapped charges, onto the surface of the charge carrier medium and built up thereon to form an electrostatic latent image. The potential of the latent image after transfer onto the charge carrier medium was measured. The results are plotted in FIG. 14.

Figure 14:
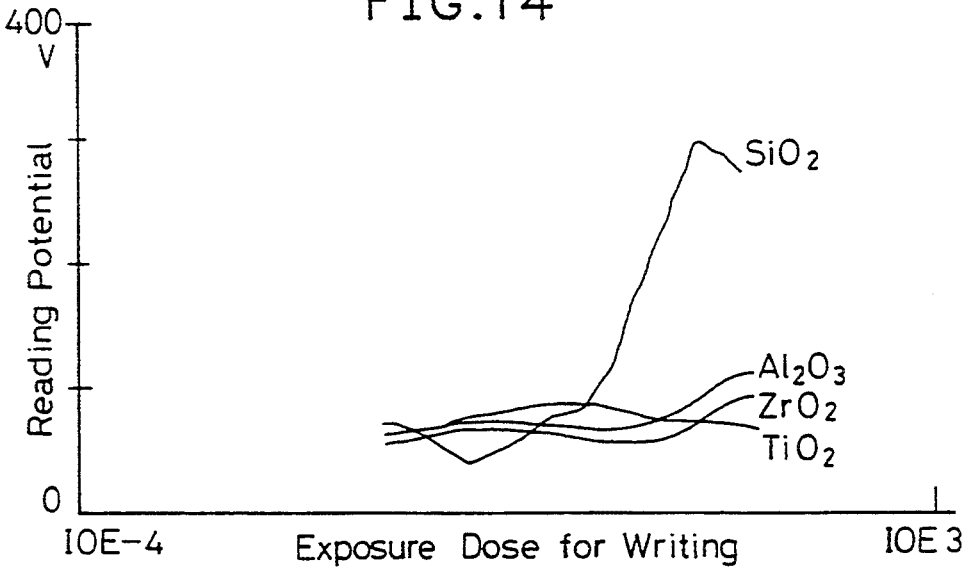
FIG. 14 is a graph showing the relation between the exposure dose and the reading potential in the photosensitive memory.

In FIG. 14 with the exposure dose as abscissa and the potential reading after transfer onto the charge carrier medium as ordinate, there are shown potential readings obtained with varying blocking layer materials.

As can be understood from FIG. 14, it is when an $SiO_2$layer was used as the blocking layer that the potential corresponding to the exposure dose could be obtained.

As stated above, the photosensitive memory using the $SiO_2$ layer as the blocking layer has the property of being capable of recording images when they are exposed to light; that is, it is possible to pre-record images directly in the photosensitive memory itself in the embodiments shown in FIGS. 8–12. With this arrangement, the structure of the moving image pickup device can be much more simplified. In other words, it is possible to dispense with the charge carrier medium, because the electrostatic image can be reproduced by subjecting the recorded photosensitive memory to corona charging.

An embodiment of this invention making use of a recording medium for picking up moving images, which contains photoconductive fine particles, will now be explained with reference to FIGS. 15(*a*)–15(*d*), 16(*a*)–16(*b*) and 17(*a*)–17(*b*).

Figure 15A:
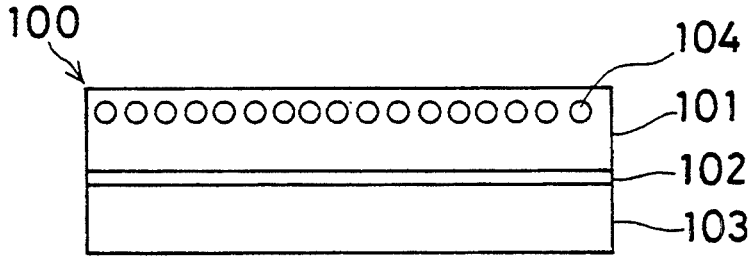
FIGS. 15*a*–15*d* are views for illustrating the formation of an image with a recording medium having an insulating layer containing photoconductive fine particles.

Referring to FIG. 15*a*, a transparent electrode 102 and an insulating resin layer 101 are laminated on a transparent support film 103 in this order, and either a single layer of fine particles or double or more layers of fine particles are provided in the vicinity of the surface of the resin layer 101.

For the insulating resin layer, use may be made of thermoplastic resins, thermosetting resins, energy beam setting resins such as ultraviolet or electron beam setting resins, engineering plastics, various forms of rubber or the like.

The thermoplastic resins used, for instance, may include polyethylene, vinyl chloride resin, polypropylene, styrene resin, ABS resin, polyvinyl alcohol, acrylic resin, acrylonitrile-styrene based resin, vinylidene chloride resin, AAS (ASA) resin, AES resin, cellulose derivative resin, thermoplastic polyurethane, polyvinyl butyral, poly-4-methylpentene-1, polybutene-1 and rosin ester resin.

The thermoplastic resins used, for instance, may include unsaturated polyester resin, epoxy resin, phenolic resin, urea resin, melamine resin, diallyl phthalate resin and silicone resin.

The resins capable of being set by energy beams such as ultraviolet and electron beams may be radically polymerizable acrylate based compounds having hydroxyl groups at both their ends, such as acrylic or methacrylic acids or their ester compounds. More specifically, use may be made of (meth) acrylate compounds having one polymerizable unsaturated group such as hydroxyethyl acrylate, hydroxypropyl acrylate, hydroxybutyl acrylate, hydroxyethyl methacrylate, hydroxypropyl methacrylate, hydroxybutyl methacrylate, 4-hydroxycyclohexyl acrylate, 5-hydroxycyclooctyl acrylate and 2-hydroxy-3-phenyloxypropyl acrylate and compounds having two polymerizable unsaturated groups, particularly one having the following formula:

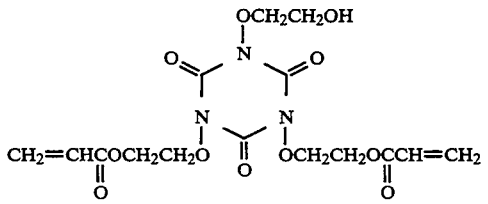

For the setting compounds having two hydroxyl groups and one or two radically polymerizable unsaturated groups, for instance, reference may be made to glycerol methacrylate and acrylates represented by the following general formula:

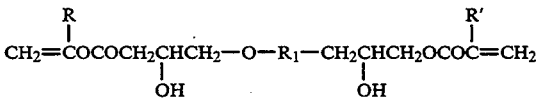

wherein R and R′ each stand for a methyl group or hydrogen and $R_1$ indicates a short-chain diol residue such as ethylene glycol, propylene glycol, diethylene glycol, butanediol and 1,6-hexanediol.

For the engineering plastics, use may be made of fluoroplastic, polycarbonate, polyamide, acetal resin, polyphenylene oxide, polybutylene terephthalate, polyethylene terephthalate, polyphenylene sulfide, polyimide resin, polysulfone, polyether sulfone, aromatic polyester and polyacrylate, by way of example.

Alternatively, a film such as a silicon, polyester, polyimide, fluorine-containing, polyethylene, polypropylene, polyparabanic acid, polycarbonate or polyamide film may be bonded onto the electrode 13 of the charge carrier medium through an adhesive or the like in the form of a layer, which may be used as a replacement to the above thermoplastic resin.

The fine particles in which charges are to be stored may be obtained from photoconductive materials, which may be either an inorganic photoconductive material such as silicone, whether amorphous or crystalline, selenium, whether amorphous or crystalline, crystalline cadmium or zinc oxide or an organic photoconductive material such as one based on a polyvinyl carbazole, phthalocyanine or azo pigment.

Reference will now be made to how to form the fine particle layer.

As can be best seen from FIG. 15*a*, the fine particles are laminated in the resin layer and in the vicinity of the surface thereof in the form of a single or plural layers. This may be achieved by the vapor deposition of a particle layer-forming material onto an unset, molten or softened resin layer laminated on the support with the use of low-pressure vapor-deposition equipment. Upon being evaporated at a low pressure of the order of 10 to $10^{-3}$ Tort, the particle layer-forming material is put in an ultrafine (about 10–0.1 μm) particle state due to its coagulation. If the resin layer is put in a softened state by heating during vapor deposition, these ultrafine particles are then laminated in the resin layer and in the vicinity of the surface thereof in the form of an aligned single or plural layers. The resin layer, if formed of a thermoplastic resin, may be softened either by subjecting its electrode layer by resistance heating or by applying direct heating to its substrate as by a heater, or the resin layer, if formed of a resin set by heat, ultraviolet or electron beams, may be provided in an unset state with the particle layer-forming material by vapor deposition and then set by suitable setting means.

Alternatively, the fine particle layer may be provided in the resin layer and in the vicinity of the surface thereof by similar vapor deposition of a single or plural layers of particles onto a support having said resin layer pre-formed and -set on an electrode substrate. In this case, the particle layer is formed on the surface of the resin layer. Thereafter, an insulating resin, which may be identical with or different from that used for the formation of said resin layer, is directly applied in the range of 0.1 to 30 μm by dry lamination procedures such as vacuum deposition or sputtering. This may also be achieved in a wet manner in which a solution of resin dissolved in a solvent is formed into a film by spinner coating, dipping or blade coating, followed by the evaporation of the solvent. In order to enable the particulate layer to have a uniform particle size during its formation, the substrate may be heated at a temperature at which the resin layer remains unmolten.

It is understood that while the photoconductive particle layer has been described as being provided in the insulating resin layer in the form of a single or plural layers, the resin and particulate layers may be laminated onto the substrate in this sequence. To this end, the particulate layer-forming material is dispersed in the resin layer-forming material with a suitable setting agent, e.g., a solvent, and the dispersion is applied onto the resin layer pre-formed on the support by suitable means such as coating or dipping.

Figure 15B:
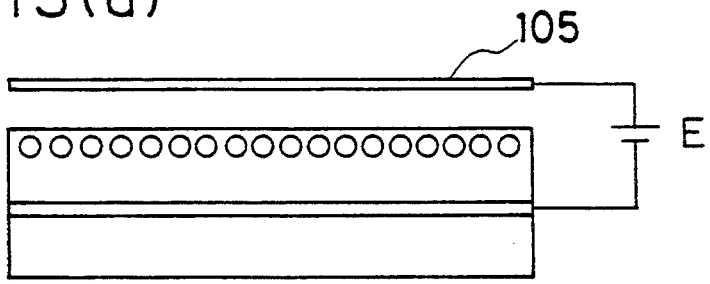
Figure 15C:
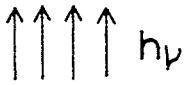
Figure 15C:
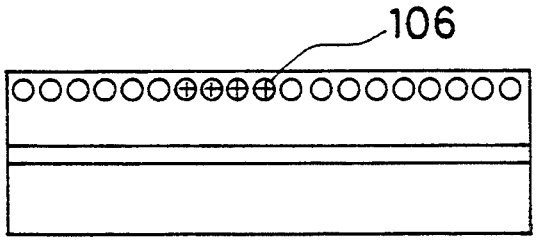
Figure 15D:
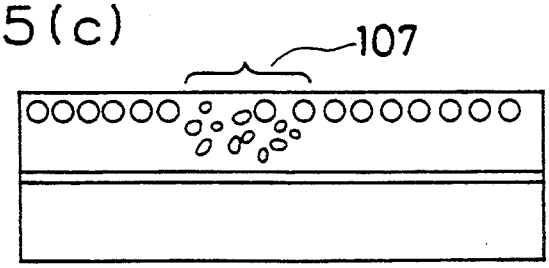

As can be best seen from FIG. 15*b*, voltage is then impressed between the photoconductive particle layer-containing insulating resin layer 101 of the recording medium 100 and the photoconductor 105 located in opposition thereto. When exposure is carried out from the medium 100 in this state, carriers are produced in the photoconductive fine particle layer 104 over an exposed region, so that discharge can take place between that layer 104 and the electrode 105, giving rise to positive (or negative) charges in the photoconductive fine particles and thus forming a latent image (see FIG. 15*c*). With the charges produced in the fine particles, charges opposite in polarity to them are induced in the transparent electrode 102, so that an electric field can be created between the electrode and the fine particles, giving rise to electrical attraction force. In this case, when the medium 100 is formed of, e.g., a thermoplastic resin, the resin layer is plasticized upon heated to form a charged image, and the photoconductive fine particles, on which the electrical attraction force acts, migrate to the electrode and are then dispersed in the resin layer. Upon being cooled, they are fixed in this state (see FIG. 15*d*). Upon being irradiated with light, a region 107 with the fine particles dispersed in it undergoes light scattering, while the other region is transparent to the light; the region exposed to light can be viewed in the form of a visual image.

FIGS. 16(*a*)–16(*b*) and 17(*a*)-14 17(*b*) represent how to pick up a moving image with the use of the recording medium explained with reference to FIGS. 15(*a*)–15*d*).

Figure 16A:
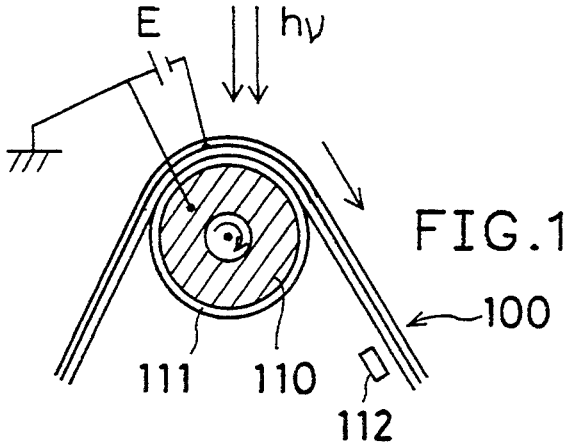
FIGS. 16*a* and 16*b* are views for illustrating a moving image pickup device using the recording medium of FIG. 15.

FIG. 16*a* is directed to forming a moving image by voltage-applied exposure wherein the image is exposed to light, while the medium 100 is successively fed to an electrode roller 110 provided with a spacer 111 such that the photoconductive fine particle layer-containing resin layer is wound around it and voltage is impressed between the electrode roller 110 and the transparent electrode of medium 100. In consequence, the charged image is formed in the photoconductive fine particle layer, as explained with reference to FIGS. 15(*a*)–15(*d*), and this can be visualized by heating with heating equipment 112. In this case, however, it is noted that it is not required to visualize the charged image just after its formation; it may be developed later in off-line, because the charges formed by voltage-applied exposure can be stored stably in the photoconductive fine particles.

Figure 16B:
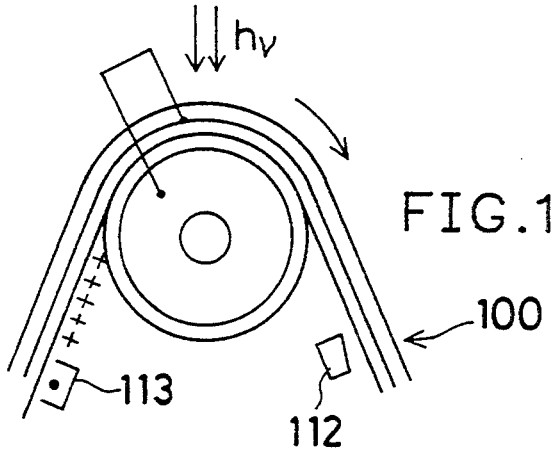

FIG. 16*b* is directed to forming a moving image by short-circuit exposure. When the medium 100 pre-charged uniformly with a corona electrical charging unit 113, for instance, and the electrode roller 110 are short-circuited, charges opposite in polarity to the surface ones, which have been induced by corona electrical charging, migrate to the electrode roller 110, resulting in voltage being generated between the electrode roller and the surface of the medium. Then, when the image is exposed to light, a charged image is formed in the photoconductive fine particles, as is the case with FIG. 16*a*. With the medium heated with the heater 112, the charges accumulated uniformly on the surface of a region of the resin layer not exposed to light leak out of it and the photoconductive fine particles in the plasticized resin layer are attracted by the voltage occurring between that resin layer and the electrode roller and dispersed in thai resin layer. Upon being cooled, this state is fixed to form a visual image.

Figure 17A:
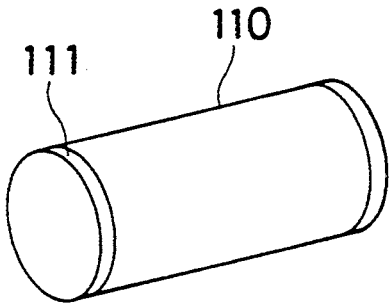
FIG. 17 is views for illustrating an electrically conductive drum.
Figure 17B:
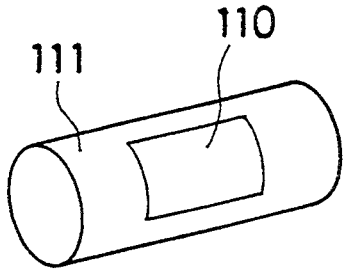

It is noted that the above electrode roller 110 may take various suitable forms; for instance, it may be made up of an electrically conductive, cylindrical roller provided on both its outer edges with spacers 111, as shown in FIG. 17*a*, or an electrically conductive, cylindrical roller which is provided with a spacer 111 all over the surface, saving its image-forming region.

FIGS. 18(*a*)–18(*b*) represent one embodiment of this invention wherein the photosensitive material is cleared of a residual image by allowing it to be irradiated with light. In FIGS. 18(*a*)–18(*b*), reference numeral 120 stands for a photosensitive material, 121 a support, 122 a transparent electrode, 123 a photoconductive layer, 130 a charge carrier medium, 140 a power source, 141 a switch, and 151 and 152 feed rollers.

Figure 5:
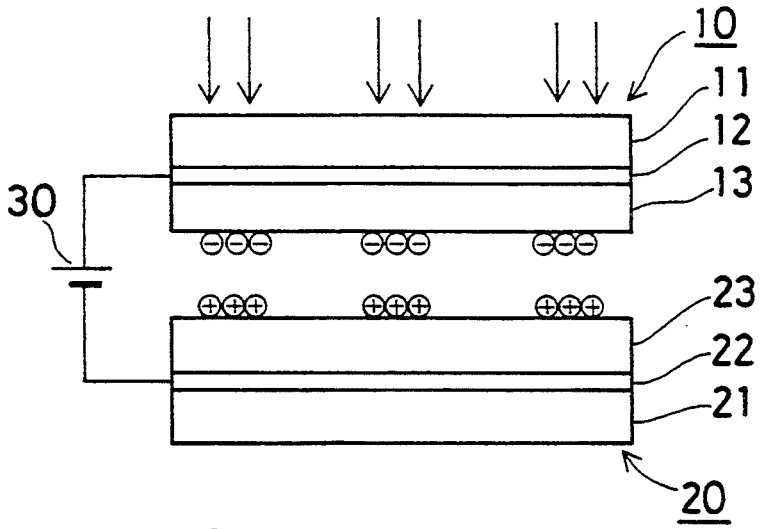
FIG. 5 is a view for illustrating a conventional image-recording system.

In order to accommodate to continuous image pickup, the charge carrier medium 130 is in a film form, for instance, and is designed to be successively fed to the position of the photosensitive material 120 through the rollers 151 and 152. When voltage-applied exposure is carried out while this film form of charge carrier medium 130 is located in opposition to the photosensitive material 120, charges whose polarity corresponds to the conditions for forming an image are accumulated on the surface of the photoconductive layer 123, as explained with reference to FIG. 5. When the next voltage-applied exposure is immediately carried out in this state, the charges thus accumulated, which remain undecayed, have some adverse influence on the film 130. Prior to the next voltage-applied exposure, therefore, the switch 141 is turned off while the photosensitive material 120 is spaced away from the film 130 by a given distance to expose it to light all over the surface. Then, the photoconductive layer 123 is made so electrically conductive that the surface charges can be eliminated by coupling to the carriers in the photoconductive layer or by leaking. On the other hand, since no voltage is impressed between the photosensitive material 120 and the film 130, no discharge takes place between them; nor is the film 130 affected by uniform exposure at all.

Figure 6:
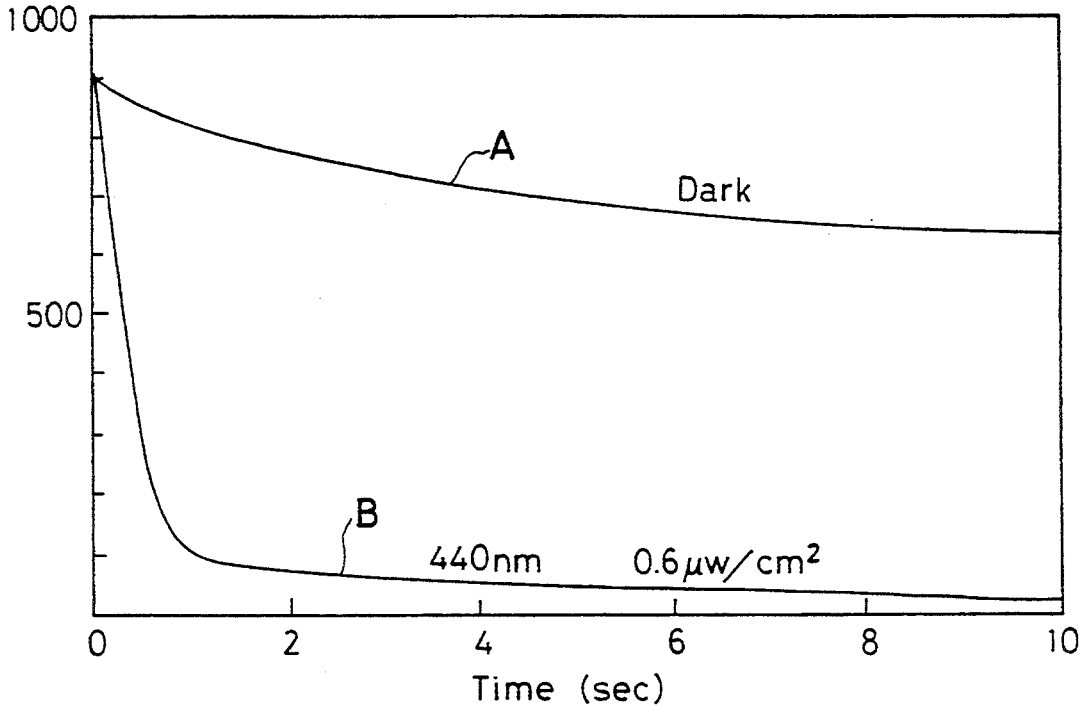
FIG. 6 is a graph for illustrating a potential decay when a selenium photosensitive material is used.
Figure 7A:
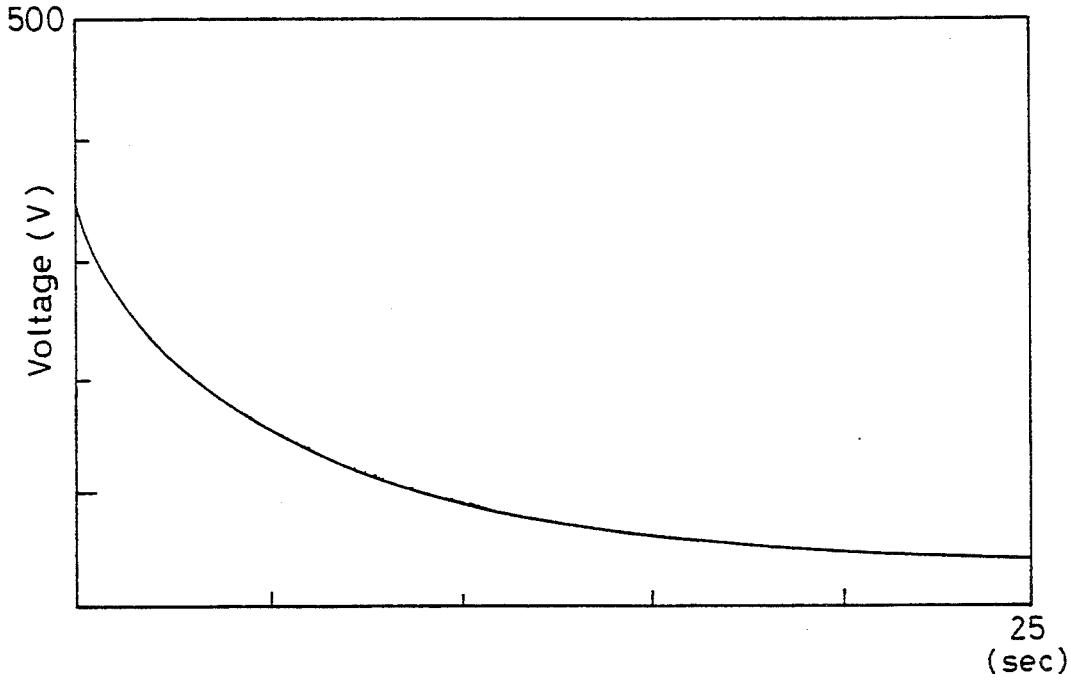
FIGS. 7*a* and 7*b* are graphs for illustrating a potential decay when an organic photosensitive material is used.
Figure 7B:
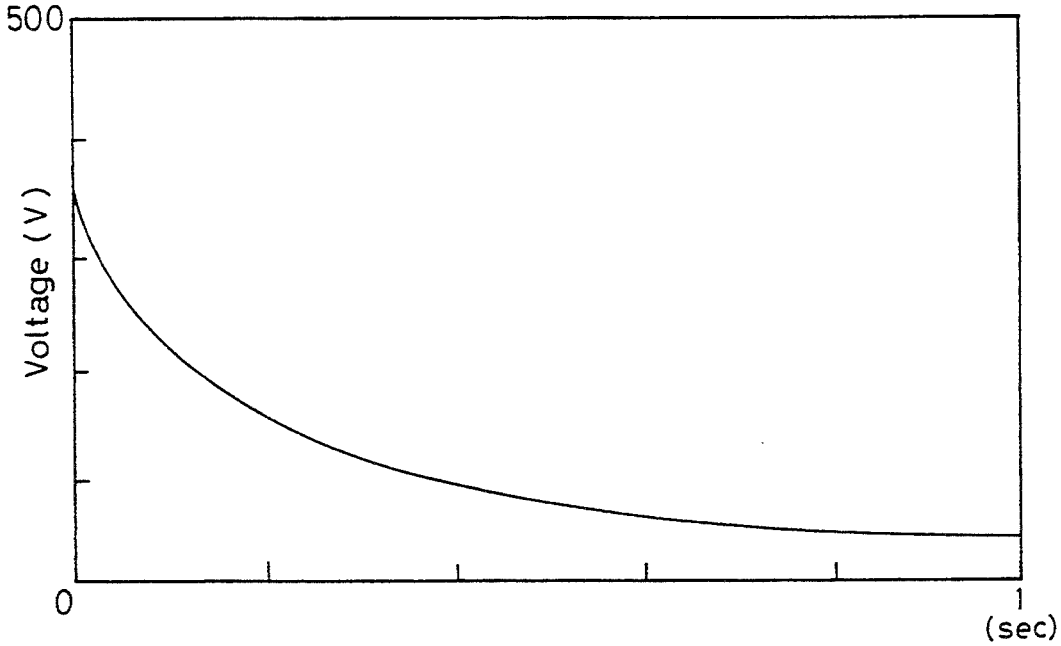

When the photosensitive member of, e.g., selenium is irradiated with light of 440 nm and 0.6 $\mu w/cm^2$, the residual charges could decay within about 1 second at an initial voltage of 900V, as shown by a characteristic curve B in FIG. 6. When an organic photosensitive material is irradiated with light having a wavelength of 540 nm and a power of 0.6 $\mu w/cm^2$, on the other hand, the residual charges could decay in a matter of about 1 second, as shown in FIG. 7*b*.

Thus, the photosensitive material can be rapidly cleared of a residual image by exposing it to light all over the surface prior to the next voltage-applied exposure. It is understood that the photosensitive material 120 may be exposed to light all over the surface either from the photoconductive layer or from the support, while it is turned and located at right angles with respect to the charge carrier medium.

Figure 19:
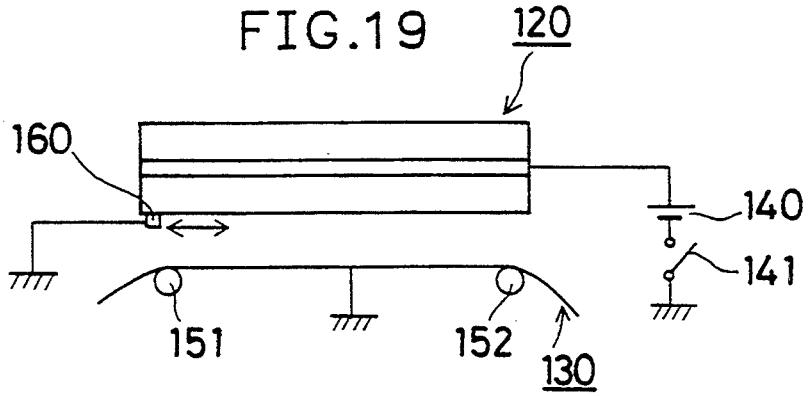
FIG. 19 is a view showing an embodiment of this invention wherein an electrically conductive member is brought into contact with the surface of a photosensitive material cause leakage of charges.

FIG. 19 represents an embodiment of this invention wherein an electrically conductive member is brought into contact with the surface of the photosensitive material for leakage of charges.

In this embodiment, for instance, a metal foil 160 is moved along the surface of the photosensitive material, while in contact with it, for earthing, whereby the charges can be decayed by their leakage.

Figure 20:
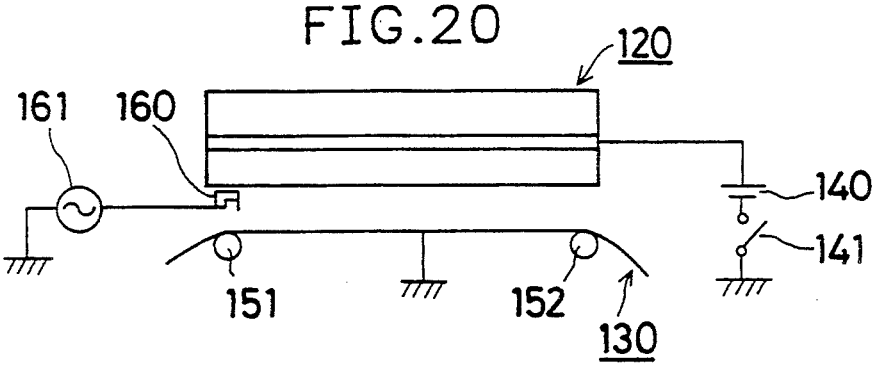
FIG. 20 is a view showing an embodiment of this invention wherein an a.c. current is superimposed on an electrically conductive member to bring it into contact with a photosensitive material for the neutralization of charges.

Rapid decay of the surface charges from the photosensitive material may also be achieved by superimposing an a.c. current from an a.c. power source 161 onto a metal foil 160 in contact with the photosensitive material, as shown in FIG. 20, whereby they are neutralized.

Figure 21:
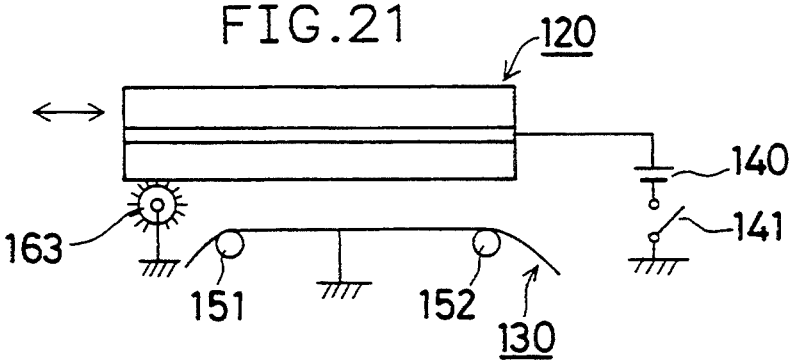
FIG. 21 is a view showing an embodiment of this invention wherein an antistatic brush is used for leakage of charges.
Figure 22:
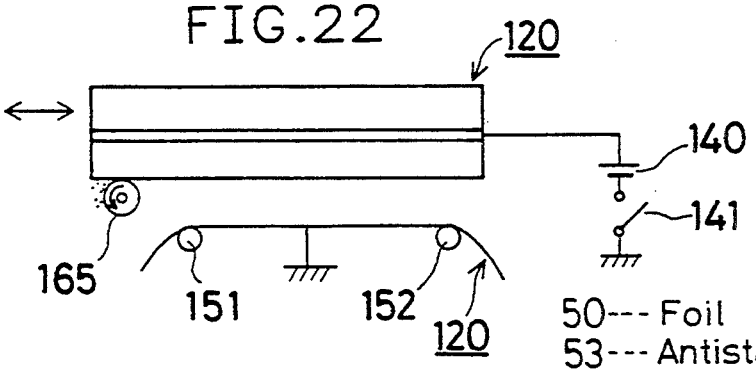
FIG. 22 is a view showing an embodiment of this invention wherein charges are saturated by release charging.

Alternatively, leakages of charges may be achieved by the use of an antistatic brush, as shown in FIG. 21.

Figure 23:
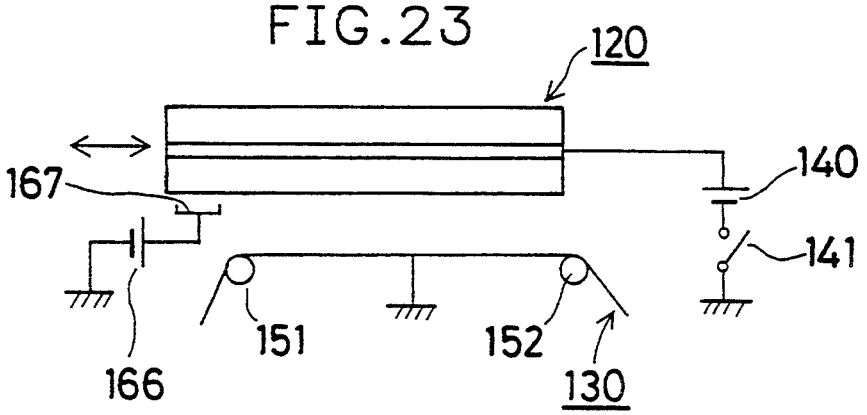
FIGS. 23 and 24 are views showing an embodiment of this invention wherein charges are saturated by discharge.
Figure 24:
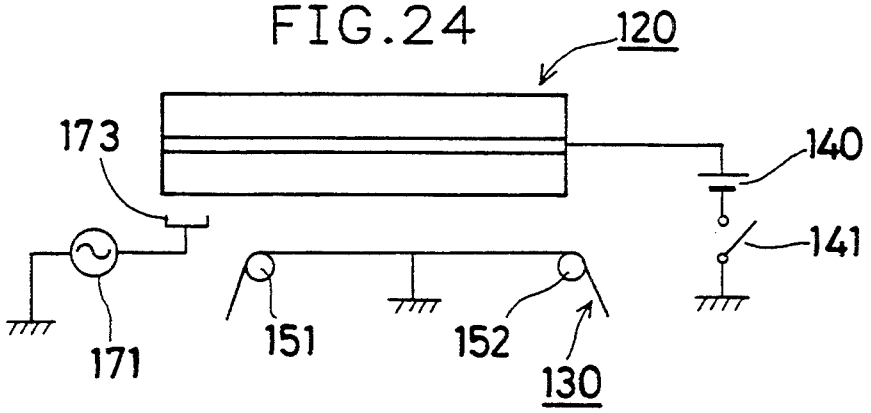

Further alternatively, the residual image may be removed by release charging in which a charging roller 165 is moved along the surface of the photosensitive material and rubbed thereby, d.c. discharge which takes place through a discharge electrode 167, as shown in FIG. 23, or the use of a charging unit 173, as shown in FIG. 24, through which an a.c. voltage is applied from an a.c. power source 171 to the surface of the photosensitive material to charge it uniformly by a.c. corona.

Figure 25:
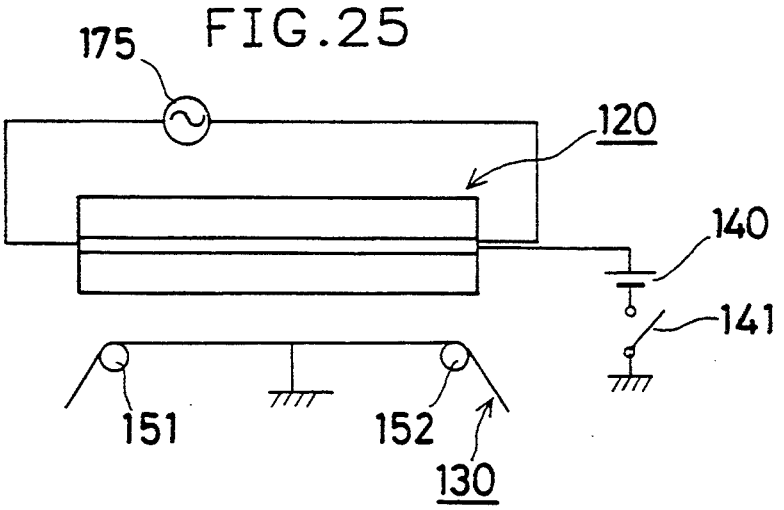
FIG. 25 is a view showing an embodiment of this invention wherein leakage of charges takes place by heating a photosensitive material.

FIG. 25 represents an embodiment of this invention wherein the photosensitive material is heated for leakage of residual charges.

In this embodiment, an a.c. current is fed from an a.c. power source 175 through the electrode to induce a thermostimulant current with respect to the photoconductive layer, thereby clearing the photosensitive material of residual charges.

Figure 26:
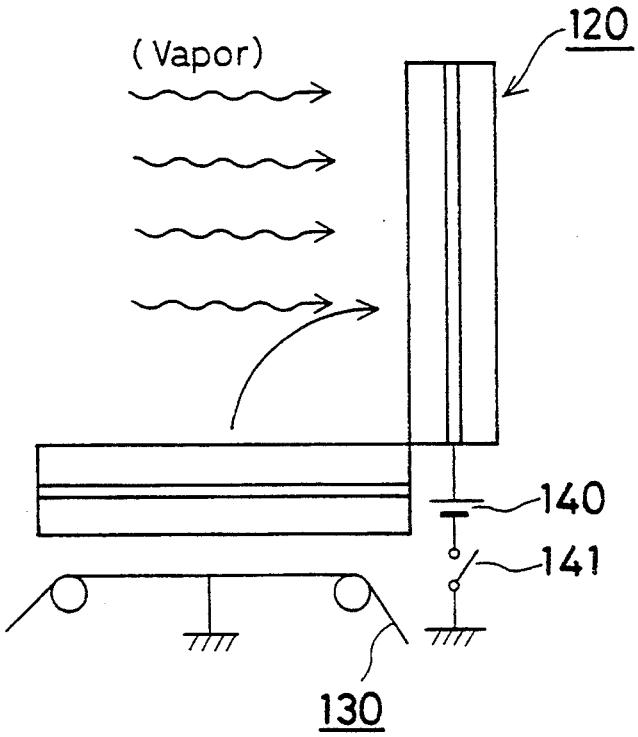
FIG. 26 is a view showing an embodiment of this invention wherein an electrically conductive liquid or gas is brought into contact with a photosensitive material for leakage of charges.

FIG. 26 represents an embodiment of this invention wherein an electrically conductive vapor, e.g., water vapor is blown onto the photosensitive material for leakage of residual charges.

According to this embodiment, water vapor may be blown onto the photosensitive material turned at right angles, for instance. Instead of water vapor, an electrically conductive liquid, for instance, an electrolyte may flow along the surface of the photosensitive material. Most preferable for continuous image pickup is the use of a volatile liquid or gas, because the photosensitive material is immediately dried.

INDUSTRIAL APPLICABILITY

In accordance with the present invention wherein the charge carrier medium or photosensitive memory is successively fed to form electrostatic latent images which can then be visualized by development, it is possible to pick up moving images of high resolution. It is also possible to clear the photosensitive material of residual charges, whereby electrostatic images of high quality can be obtained by picking up moving images continuously. Thus, the present invention can be used for recording moving images of very high quality and will have various applications.

What is claimed is:

1. A moving image pickup device characterized by including:

a rotationally driven drum form of photosensitive material which has a photoconductive layer and a spacer laminated on a drum having an electrically conductive layer on its surface, a charge carrier medium having a transparent, electrically conductive layer and a transparent insulating layer laminated on a transparent support, said charge carrier medium being successively fed to said drum form of photosensitive material such that said transparent insulating layer thereof is wound around said drum form of photosensitive material with said transparent insulating layer in spaced, face-to-face relationship with the photoconductive layer of said drum form of photosensitive material, means for applying voltage between said electrically conductive layers of said drum form of photosensitive material and said charge carrier medium, image exposure means for exposing in accordance with a part of said image via beam or linear slit scanning light said drum form of photosensitive material at a position where said drum form of photosensitive material is opposite to said charge carrier medium, and a charge-clearing light source for irradiating said drum form of photosensitive material with light to clear it of a residual charged image, said image exposure means synchronizing the scanning light with the rotation of said drum form of photosensitive material and the feed of said charge carrier medium to record said image on said charge carrier medium successively frame by frame at a given timing.

2. A moving image pickup device characterized by including:

a rotationally driven drum form of photosensitive material which has a photoconductive layer laminated on a drum having an electrically conductive layer on its surface, a charge carrier medium having a transparent, electrically conductive layer, a transparent insulating layer and a spacer laminated on a transparent support, said charge carrier medium being successively fed to said drum form of photosensitive material such that said transparent insulating layer thereof is wound around said drum form of photosensitive material with said transparent insulating layer in spaced, face-to-face relationship with the photoconductive layer of said drum form of photosensitive material, means for applying voltage between said electrically conductive layers of said drum form of photosensitive material and said charge carrier medium, image exposure means for exposing in accordance with a part of said image via beam or linear slit scanning light said drum form of photosensitive material at a position where said drum form of photosensitive material is opposite to said charge carrier medium, and a charge-clearing light source for irradiating said drum form of photosensitive material with light to clear it of a residual charged image, said image exposure means synchronizing the scanning light with the rotation of said drum form of photosensitive material and the feed of said charge carrier medium to record said image on said charge carrier medium successively frame by frame at a given timing.

3. A moving image pickup device characterized by including:

a rotationally driven drum form of photosensitive material which has a photoconductive layer and a spacer laminated on a drum having an electrically conductive layer on its surface, a charge carrier medium having a transparent, electrically conductive layer and a transparent insulating layer laminated on a transparent support, said charge carrier medium being successively fed to said drum form of photosensitive material such that said transparent insulating layer thereof is wound around said drum form of photosensitive material with said transparent insulating layer in spaced, face-to-face relationship with the photoconductive layer of said drum form of photosensitive material, means for charging said transparent insulating layer of said charge carrier medium uniformly, means for short-circuiting said electrically conductive layers of said drum form of photosensitive material and said charge carrier medium, image exposure means for exposing in accordance with a part of said image via beam or linear slit scanning light said drum form of photosensitive material at a position where said drum form of photosensitive material and said charge carrier medium are opposite to each other while remaining short-circuited, and a charge-clearing light source for irradiating said drum form of photosensitive material with light to clear it of a residual charged image, said image exposure means synchronizing the scanning light with the rotation of said drum form of photosensitive material and the feed of said charge carrier medium to record said image on said charge carrier medium successively frame by frame at a given timing.

4. A moving image pickup device characterized by including:

a rotationally driven drum form of photosensitive material which has a photoconductive layer laminated on a drum having an electrically conductive layer on its surface, a charge carrier medium having a transparent, electrically conductive layer, a transparent insulating layer and a spacer laminated on a transparent support, said charge carrier medium being successively fed to said drum form of photosensitive material such that said transparent insulating layer thereof is wound around said drum form of photosensitive material with said transparent insulating layer in spaced, face-to-face relationship with the photoconductive layer of said drum form of photosensitive material, means for charging said transparent insulating layer of said charge carrier medium uniformly, means for short-circuiting said electrically conductive layers of said drum form of photosensitive material and said charge carrier medium, image exposure means for exposing in accordance with a part of said image via beam or linear slit scanning light said drum form of photosensitive material at a position where said drum form of photosensitive material and said charge carrier medium are opposite to each other while remaining short-circuited, and a charge-clearing light source for irradiating said drum form of photosensitive material with light to clear it of residual charges, said image exposure means synchronizing the scanning light with the rotation of said drum form of photosensitive material and the feed of said charge carrier medium to record said image on said charge carrier medium successively frame by frame at a given timing.

5. A moving image pickup device characterized by including:

a plate form of photosensitive material including an electrically conductive layer and a photoconductive layer laminated on a support in this sequence, a charge carrier medium having an electrically conductive layer and an insulating layer laminated on a support in this sequence, said charge carrier medium being successively fed to said plate form of photosensitive material in opposite relation thereto, means for driving said plate form of photosensitive material to reciprocate it in the direction perpendicular to the direction of movement of said carrier medium, means for applying voltage between said electrically conductive layers of said photosensitive material and said charge carrier medium, image exposure means for subjecting said photosensitive material to planar exposure in accordance with said image, and a charge-clearing light source means for reciprocating and irradiating said photosensitive material with light at any position that is not opposite to said charge carrier medium, thereby clearing it of a residual charged image, the image exposure means synchronizing said planar exposure with the reciprocation of said photosensitive material and the feed of said charge carrier medium to record said image on said charge carrier medium successively frame by frame at a given timing.

6. A moving image pickup device characterized by including:

a plate form of photosensitive material including an electrically conductive layer and a photoconductive layer laminated on a support in this sequence, a charge carrier medium having an electrically conductive layer and an insulating layer laminated on a support in this sequence, said charge carrier medium being successively fed to said plate form of photosensitive material in opposite relation thereto, means for driving said plate form of photosensitive material to reciprocate it in the direction perpendicular to the direction of movement of said charge carrier medium, means for charging said insulating layer of said charge carrier medium uniformly, means for short-circuiting said electrically conductive layers of said photosensitive material and said charge carrier medium, image exposure means for subjecting said photosensitive material to planar exposure in accordance with said image, while said photosensitive material and said charge carrier medium remain short-circuited by said short-circuit means, and a charge-clearing light source means for reciprocating and irradiating said photosensitive material with light at any position that is not opposite to said charge carrier medium, thereby clearing it of a residual charged image, the image exposure means synchronizing said planar exposure with the reciprocation of said photosensitive material and the feed of said charge carrier medium to record said image on said charge carrier medium successively frame by frame at a given timing.

7. A moving image pickup device characterized by including:

a rotationally driven, electrically conductive drum having an insulating spacer laminated on a drum having an electrically conductive layer formed on its surface, a recording medium having a transparent, electrically conductive layer and a photoconductive fine particle-containing transparent insulating resin layer laminated on a transparent support in this sequence, said recording medium being successively fed to said drum such that said transparent insulating resin layer thereof is wound around said drum in opposite relation to said spacer layer, means for applying voltage between said electrically conductive layers of said drum and recording medium, and image exposure means for providing beam or linear slit scanning exposure in accordance with a part of said image at a position where said electrically conductive drum is opposite to said recording medium, said image exposure means synchronizing said scanning exposure with the rotation of said electrically conductive drum and the feed of said recording medium to record said image on said recording medium successively frame by frame at a given timing.

8. A moving image pickup device as claimed in claim 7, wherein said spacer is laminated on the outermost surface layer of said recording medium.

9. A moving image pickup device characterized by including:

a rotationally driven drum form of electrical conductor having an insulating spacer laminated on a drum having an electrically conductive layer formed on its surface, a recording medium having a transparent, electrically conductive layer and a photoconductive fine particle-containing transparent insulating layer laminated on a transparent support with said transparent insulating layer being successively fed to said drum form of electrical conductor, means for charging said transparent insulating layer of said recording medium uniformly, means for short-circuiting said drum form of electrical conductor and said recording medium, and image exposure means for providing beam or linear slit scanning exposure in accordance with said image at a position where said drum form of electrical conductor and said recording medium are opposite to each other while remaining short-circuited, said image exposure means synchronizing said scanning exposure with the rotation of said drum form of electrical conductor and the feed of said recording medium to record said image on said recording medium successively frame by frame at a given timing.

10. A moving image pickup device as claimed in claim 9, in which said spacer is laminated on the surface layer of said recording medium.

11. A process for picking up and recording electrostatic images continuously in which, while a photosensitive material having a photoconductive layer formed on an electrically conductive layer is located in spaced opposition to a charge carrier medium having an insulating layer on an electrically conductive layer, said photoconductive layer is exposed to light in accordance with an image of said images while a voltage is provided between both said electrically conductive layers, characterized in that after said voltage-applied exposure, residual charges are removed out of the surface of said photosensitive material or a residual image is eliminated from the surface of said photosensitive material by charging it uniformly, whereupon the next voltage-applied exposure is carried out for picking up said images continuously, said steps of locating said photosensitive material, exposure and removal of residual charges being performed repeatedly in synchronization for recording said images on said charge carrier medium successively frame-by-frame.

12. A process for picking up and recording electrostatic images continuously as claimed in claim 11, characterized in that said residual image is removed by exposing either side of said photosensitive material to light uniformly all over the surface.

13. A process for picking up and recording electrostatic images continuously as claimed in claim 11, characterized in that said residual image is removed by bringing an electrically conductive member into contact with the surface of said photosensitive material.

14. A process for picking up and recording electrostatic images continuously as claimed in claim 11, characterized in that said residual image is eliminated by locating an electrically conductive member in opposition to the surface of said photosensitive material for charging.

15. A process for picking up and recording electrostatic images continuously as claimed in claim 11, characterized in that said residual image is eliminated by charging the surface of said photosensitive material uniformly by d.c. or a.c. discharge.

16. A process for picking up and recording electrostatic images continuously as claimed in claim 11, characterized in that said residual image is eliminated by heating said photosensitive material.

17. A process for picking up and recording electrostatic images continuously as claimed in claim 11, characterized in that said residual image is eliminated by exposing the surface of said photosensitive material to an electrically conductive liquid or gas.

18. A moving image pickup device as claimed in claim 1, characterized in that said transparent insulating layer is a transparent thermoplastic resin layer, an additional heating means is provided for heating said charge carrier medium after said image exposure, and a frosted image is formed by voltage-applied exposure.

19. A moving image pickup device as claimed in claim 2, characterized in than said transparent insulating layer is a transparent thermoplastic resin layer, an additional heating means is provided for heating said charge carrier medium after said image exposure, and a frosted image is formed by voltage-applied exposure.

20. A moving image pickup device as claimed in claim 3, characterized in that said transparent insulating layer is a transparent thermoplastic resin layer, an additional heating means is provided for heating said charge carrier medium after said image exposure, and a frosted image is formed by voltage-applied exposure.

21. A moving image pickup device as claimed in claim 4, characterized in that said transparent insulating layer is a transparent thermoplastic resin layer, an additional heating means is provided for heating said charge carrier medium after said image exposure, and a frosted image is formed by voltage-applied exposure.

22. A moving image pickup device as claimed in claim 5, characterized in that said insulating layer of said charge carrier medium is a transparent thermoplastic resin layer, an additional heating means is provided for heating said charge carrier medium after said .image exposure, and a frosted image is formed by voltage-applied exposure or post-charging short-circuit exposure.

23. A moving image pickup device as claimed in claim 6, characterized in that said insulating layer of said charge carrier medium is a transparent thermoplastic resin layer, an additional heating means is provided for heating said charge carrier medium after said image exposure, and a frosted image is formed by voltage-applied exposure or post-charging short-circuit exposure.

24. A moving image pickup device as claimed in claim 7, wherein said transparent insulating layer is a transparent thermoplastic resin layer and an additional heating means is provided for heating said recording medium after said image exposure to form a transmission type of visual image.

25. A moving image pickup device as claimed in claim 9, characterized in that said transparent insulating layer is a transparent thermoplastic resin layer and an additional heating means is provided for heating said recording medium after said image exposure to form a transmission type of visual image.

26. A moving image pickup recording medium used with a moving image pickup device as claimed in claim 7, characterized in that said photoconductive fine particles are present in said insulating resin layer and in the vicinity of the surface thereof in the form of single or plural layers.

27. A moving image pickup recording medium used with a moving image pickup device as claimed in claim 9, characterized in that said photoconductive fine particles are present in said insulating resin layer and in the vicinity of the surface thereof in the form of single or plural layers.

* * * * *